US009234725B2

(12) United States Patent
Diaz

(10) Patent No.: US 9,234,725 B2
(45) Date of Patent: Jan. 12, 2016

(54) GREEN ENERGY MINE DEFEAT SYSTEM

(71) Applicant: Kevin Mark Diaz, Dorchester, MA (US)

(72) Inventor: Kevin Mark Diaz, Dorchester, MA (US)

( * ) Notice: Subject to any disclaimer, the term of this patent is extended or adjusted under 35 U.S.C. 154(b) by 275 days.

(21) Appl. No.: 13/754,317

(22) Filed: Jan. 30, 2013

(65) Prior Publication Data

US 2014/0007756 A1 Jan. 9, 2014

Related U.S. Application Data

(63) Continuation-in-part of application No. 13/538,068, filed on Jun. 29, 2012, now Pat. No. 8,677,876, which is a continuation-in-part of application No. 13/184,505, filed on Jul. 16, 2011, now Pat. No. 8,240,239.

(51) Int. Cl.

| | |
|---|---|
| ***F41H 7/04*** | (2006.01) |
| ***F41H 11/16*** | (2011.01) |
| ***F41H 11/13*** | (2011.01) |
| ***F41H 7/00*** | (2006.01) |
| ***F41H 5/20*** | (2006.01) |
| ***F41H 5/007*** | (2006.01) |
| ***F41H 5/06*** | (2006.01) |
| ***F41H 11/00*** | (2006.01) |
| ***F41H 11/18*** | (2011.01) |
| ***F41H 11/28*** | (2011.01) |

(52) U.S. Cl.

CPC ..... *F41H 11/13* (2013.01); *F41H 5/007* (2013.01); *F41H 5/06* (2013.01); *F41H 5/20* (2013.01); *F41H 7/005* (2013.01); *F41H 7/042* (2013.01); *F41H 11/00* (2013.01); *F41H 11/16* (2013.01); *F41H 11/18* (2013.01); *F41H 11/28* (2013.01)

(58) Field of Classification Search

CPC ..... F41H 5/013; F41H 5/02; F41H 5/04; F41H 5/023; F41H 5/14; F41H 5/16; F41H 7/04; F41H 7/00; F41H 7/048

USPC ..... 89/1.13, 36.01, 36.02, 36.07, 36.08, 89/36.09; 102/402; 86/50

See application file for complete search history.

(56) References Cited

U.S. PATENT DOCUMENTS

| | | | | | |
|---|---|---|---|---|---|
| 2,005,392 | A | * | 6/1935 | Remus | 37/274 |
| 2,419,308 | A | * | 4/1947 | Ellsworth | 89/1.13 |
| 3,152,442 | A | | 10/1964 | Rowekamp | |
| 3,820,479 | A | * | 6/1974 | Fylling | 109/1 R |
| 3,837,259 | A | * | 9/1974 | Vaughn | 89/1.13 |
| 4,036,104 | A | * | 7/1977 | Pagano | F41H 7/04 89/36.02 |
| 4,467,694 | A | * | 8/1984 | Azulai et al. | 89/1.13 |
| 4,552,053 | A | * | 11/1985 | Bar-Nefy et al. | 89/1.13 |
| 4,585,387 | A | * | 4/1986 | Jayne | 414/730 |
| 4,621,562 | A | * | 11/1986 | Carr et al. | 89/41.05 |
| 4,674,048 | A | | 6/1987 | Okumura | |
| 4,716,810 | A | * | 1/1988 | DeGuvera | F41H 5/013 109/83 |

(Continued)

FOREIGN PATENT DOCUMENTS

| | | | | |
|---|---|---|---|---|
| DE | 3820479 A1 | * | 2/1989 | A22C 5/00 |
| EP | 1705452 A1 | * | 9/2006 | F41H 5/013 |

*Primary Examiner* — Benjamin P Lee

(57) ABSTRACT

A semi-continuous duty, Green Technology 14, robotic vehicle providing protection and security from underground mines. A deflector blade 11 follows natural existing contours to maintain straight line paths, while simultaneously carrying a mine detector 10, a vertical reciprocating ram set 30, 32 and 33 that preloads soil while also creating forward motion, followed by an energy dissipation, reaction system and containment canopy system 22, 24, 26 & 29.

11 Claims, 11 Drawing Sheets

(56) References Cited

U.S. PATENT DOCUMENTS 4,727,940 A * 3/1988 Bar-Nefy et al. ..... 171/84
4,901,644 A * 2/1990 Nevins et al. ..... 102/293
4,919,034 A * 4/1990 Firth ..... 89/1.13
4,932,831 A * 6/1990 White et al. ..... 414/732
4,938,114 A * 7/1990 Matthews et al. ..... 89/1.13
5,033,357 A * 7/1991 Seksaria ..... F16B 5/0233 403/167
5,097,911 A * 3/1992 Kendall ..... 172/815
5,125,317 A * 6/1992 Spektor et al. ..... 89/1.13
5,237,468 A * 8/1993 Ellis ..... 360/92.1
5,263,809 A * 11/1993 Kent ..... 414/680
5,307,272 A * 4/1994 Butler et al. ..... 700/90
5,410,944 A * 5/1995 Cushman ..... 91/520
5,570,992 A * 11/1996 Lemelson ..... 414/744.3
5,576,508 A * 11/1996 Korpi ..... F41H 5/013 89/36.01
5,648,901 A * 7/1997 Gudat et al. ..... 701/23
5,712,441 A * 1/1998 Grunewald ..... 89/1.13
5,786,542 A * 7/1998 Petrovich et al. ..... 89/1.13
5,856,629 A * 1/1999 Grosch et al. ..... 89/1.13
5,869,967 A * 2/1999 Straus ..... 324/326
5,892,360 A * 4/1999 Willer et al. ..... 324/326
5,936,185 A * 8/1999 Tokuni ..... 89/1.13
5,988,037 A * 11/1999 Haughom et al. ..... 89/1.13
6,113,343 A * 9/2000 Goldenberg et al. ..... 414/729
6,302,100 B1 10/2001 Vandenberg
6,343,534 B1 * 2/2002 Khanna et al. ..... 89/1.13
6,377,872 B1 * 4/2002 Struckman ..... 700/258
6,393,959 B1 * 5/2002 Amemiya ..... 89/1.13
6,681,675 B2 * 1/2004 Miller ..... 86/50
6,809,520 B1 * 10/2004 Nelson ..... 324/329
6,879,878 B2 * 4/2005 Glenn et al. ..... 700/245
7,152,517 B1 * 12/2006 Ivey ..... B63G 9/02 114/240 B
7,198,112 B2 * 4/2007 Wanner ..... 172/19
7,228,927 B2 * 6/2007 Hass et al. ..... 180/65.25
7,296,503 B1 * 11/2007 McGrath ..... 89/1.13
7,411,337 B2 8/2008 Tadayon
7,458,306 B2 * 12/2008 Singh ..... F41H 7/04 89/36.02
7,493,974 B1 * 2/2009 Boncodin ..... 180/2.2
7,540,540 B2 * 6/2009 Kwon et al. ..... 285/411
7,565,941 B2 * 7/2009 Cunningham ..... 180/167
7,600,460 B2 * 10/2009 Manders ..... 89/1.13
7,683,821 B1 * 3/2010 Clodfelter ..... 342/22
7,712,405 B2 * 5/2010 Toycen et al. ..... 86/50
7,740,082 B2 * 6/2010 Davidson et al. ..... 171/18
7,752,953 B2 * 7/2010 Sokol et al. ..... 89/1.13
7,775,146 B1 * 8/2010 Bitar et al. ..... 89/1.13
7,884,569 B2 * 2/2011 Ward ..... 320/101
7,958,809 B1 * 6/2011 Bitar et al. ..... 89/1.13
7,987,760 B1 * 8/2011 Lundquist et al. ..... 89/1.13
8,004,816 B1 8/2011 Adler
8,234,965 B2 * 8/2012 Ravid et al. ..... F41H 5/0492 109/49.5
8,409,513 B2 4/2013 Miller
8,499,675 B2 8/2013 McCahon et al.
8,539,873 B2 * 9/2013 Gonard et al. ..... F41H 5/023 89/36.01
8,578,831 B2 11/2013 Adler et al.
2005/0257677 A1 * 11/2005 Ravid et al. ..... F41H 5/013 89/36.02
2008/0236376 A1 * 10/2008 Reeves et al. ..... 89/1.13
2009/0223355 A1 * 9/2009 Manders ..... 89/1.13
2009/0250276 A1 * 10/2009 Goodwin et al. ..... 180/65.265
2010/0275472 A1 * 11/2010 Cunningham ..... 37/403
2011/0259181 A1 * 10/2011 Lundquist et al. ..... 89/1.13
2012/0125182 A1 * 5/2012 Lundquist et al. ..... 89/1.13
2012/0137866 A1 * 6/2012 Gonard et al. ..... F41H 5/013 89/36.08
2012/0152101 A1 * 6/2012 Engleman ..... F41H 5/026 89/36.08
2012/0210854 A1 * 8/2012 Bitar et al. ..... 89/1.13

* cited by examiner

GREEN ENERGY MINE DEFEAT SYSTEM

BACKGROUND

Prior Art

The following is a tabulation of some prior art that presently appears relevant:

| U.S. Patents | | | |
|---|---|---|---|
| Pat. No. | Kind Code | Issue Date | Patentee |
| 7,493,974 | B1 | 2009 Feb. 24 | Boncodin |
| 5,856,629 | | 1999 Jan. 05 | Grosch et al. |
| 6,343,534 | B1 | 2002 Feb. 05 | Khanna et al. |
| 2,005,392 | | 1933 Apr. 18 | Remus |
| 4,589,341 | | 1986 May 20 | Clark |
| 4,519,543 | | 1985 May 28 | Szuminski |
| 6,216,740 | | 2001 Apr. 17 | Bunya |

This application is a Continuation-In-Part of application Ser. No. 13/538,068, filed Jun. 29, 2012 now U.S. Pat. No. 8,677,876 which is a Continuation-In-Part of application Ser. No. 13/184,505, filed Jul. 16, 2011 now U.S. Pat. No. 8,240, 239.

This invention relates to a green energy, battery powered, unmanned mine defeat vehicle. Current situations in specific geographic regions of the world have created a new need for defeating underground mines in desert-like terrain. This vehicle is especially to be used on existing paths in sand environments worldwide to protect against death and dismemberment, a long-time priority issue and establishes an effective tool for safe passage and security monitoring and creating secure zones. Both the facts of presence of underground mines as well as the importance of deterrence and prevention of positioning new mines are widely available to individuals. The necessity for addressing the issue of travel protection by foot on paths consisting of bare ground is the focus of the new vehicle as presented. The invention has the advantage of operating with Green Technology only and in areas that do not have conventional AC (alternating current) for charging or common petroleum based fuel sources for conventional gas engines.

The unfilled need for defeating mines in environments such as opens fields, village passages and trails between villages has always needed a method of solution. As the use of mines was common for numerous years, millions of mines are located and placing an equivalent number of humans at risk. Many green energy powered vehicles exist but do not comprehensively address mines. Many methods exist for the protection from mines for personnel vehicles. Recent studies have indicated that a new degree of effort must be made spent into the success of what is first step to defeat of mines, that of limiting the placement of them. Thus creating the benefit of secure areas. Proactive security and containment is simultaneously performed as the vehicle functions to prevent further placements of mines.

In order to connect rural areas for trade, commerce, travel and ensure village stability, establishing and maintaining safe pathways is a central strategic objective. So as to achieve this objective in harsh environments and terrain this mobile platform facilitates missions making logistically supportable operations to provide security. This will provide a new force element for establishing and for continued physical security within and between villages or in developing areas. Integrating existing and future screening programs allows for more comprehensive and safer processes. In becoming part of the force structure, this equipment adds function and strength to achieve current and future missions. With basic instruction for operation, communication skills, improvised explosive device detection, biometric identification and checkpoint procedures the defeat system participates by providing simultaneous combined activities. The necessity of having a capable defensive security underlies the ability of a village to protect and sustain itself. Villager and soldier perceptions of security are an important contributing health factor as the nuance of safety is required for stability and growth in the area. The robot machine would integrate well working forward in platoon and squad sized forces. Additional consideration is given toward the positive contributions provided in riot conditions to monitor, assess, contain, capture and control situations which are in areas of immediate importance.

Several types of solar vehicles and minesweepers for detection and destruction of mines are known, each with a disadvantage. Many solar powered vehicles exist but do not comprehensively address mines. Many methods exist for the protection from mines for personnel vehicles and utilizing unmanned robots. The previous patent for a solar vehicle U.S. Pat. No. 7,493,974 to Boncodin is for human transportation. A minesweeping vehicle, U.S. Pat. No. 5,856,629 granted to Grosch et al. is for wide-open spaces. The U.S. Pat. No. 6,343,534 to Khanna et al utilizes many latest methods for detection without a simultaneous in place trigger and containment system or marking process. The previous U.S. Pat. No. 2,005,392 to Remus addresses the use of a deflector with the disadvantage of flat surface use only. U.S. Pat. No. 4,589,341 to Clark discusses a chute but is for foam use. The U.S. Pat. No. 4,519,543 to Szuminski describes nozzles on a jet aircraft. The patent of Bunya, U.S. Pat. No. 6,216,740 acts to only control the manifold operation.

This application is a Continuation-In-Part of application Ser. No. 13/538,068, filed Jun. 29, 2012 now U.S. Pat. No. 8,677,876 which is a Continuation-In-Part of application Ser. No. 13/184,505, filed Jul. 16, 2011 now U.S. Pat. No. 8,240, 239. This invention improvement relates to the assemblies for use where economy of energy must be achieved for the controlled pressure application, dissipation and vehicle stability for the mine defeat system. There are several elements which are additive and independent included for various levels of performance. The particular machine described in the application is presented in its best mode for a single pathway clearing system as described in this specification. Synergy exists in the assembly of apparatus by first being blast triggered by the closer initial offset distance towards the mounted blast plate at the rear of assembly which is strut mounted to the vehicle platform. The pressure field is relieved and dissipated by the system of energy absorbing struts, billows curtains and expanding canopy. The machine reacts as the pressure is relieved in the pressure wave direction and each side functioning as a dissipating containment system.

This equipment clears a minimum, substantial 32 inch wide path, for personnel in single file traversing pathways with detection, verification, sensors, surveillance, disarming, detonation, containment and path marking all in one process. This method of defeating a mine keeps people and personnel at a distance from the hazard with prevention, simultaneously. Pressure wave, fire and fragmentation from all mines occur within milliseconds of triggering the device and it is necessary to defeat this type of device from placement to containment, specifically anti-personnel type mines. The one vehicle makes available the necessary functions of soft protection methods and direct mechanized means. This addresses the two-part problem of mines, protection from initial placement while also providing safe detection, removal and containment, a combined comprehensive approach to defeating mines.

SUMMARY

It is the objective of the present invention to create a new use for a combined powered vehicle to provide an improved combined compact mine detector, monitor and sweeper and containment apparatus in the most austere environments to run as conventional fuel driven power or using Green Technology. The vehicle is a battery based DC (direct current) motor drive recharged with a green energy module attached onto the forward sloping frame. It does not require daily fueling. Introducing equipment that is designed to be small in size and intended to be durable and cost sacrificial utilizing mechanical and detection means having the advantage of self-contained capabilities. The goals and approach are solely based on control of spaces at risk to mine placement and provide a cost-effective, high performance solution with known survivability limitations and budget-sacrificial equipment loss and only life saving and casualties reduction made as a variables of measured value.

Operation speed and maneuvering including tight turning is afforded by the fact of equal wheel base to track width yielding nearly a zero turning radius. Any of the customary control methods are possible, including remote or wired joystick as leader-follower arrangement, satellite, or run automatically on memory-learned pathways for routine path mine checking.

Common current field practice operating unmanned vehicle involves avoiding and maneuvering around debris and small stones and rocks, which lay in a path between two points of the objective route. A deflector that has multiple panel segments may naturally track downward onto the existing path cross-section. The deflector may be counterweighted. The assembly may retract for protection during deactivation attempts or detonation.

A remote retractable robotic arm is deployed to execute disarming when desired. An air tube routed to the deflector base from the gas ejection system is a tool for air blasting sand to uncover mines. Optional sensors read incoming path profile and controls deflector and the probe assembly. The feedback loop created maintains a telemetry system for all ground sensors. Procedure also may include sidestepping mine and installing a flag for the affected area.

For normal conditions, the vehicle travels and a simultaneous area proofing and fragmentation protection system operates, a new countermeasure for field use. A specifically arranged configuration and assembly for replicating foot motion and pressure with a compound articulating mechanism is employed. A controlled pressure (0 to 30 psi) vertical reciprocating system for mine activation is utilized for positive soil contact and pressure to be delivered across the width of the vehicles pathway. A curtain billows, plate and canopy system for detonation dampening for expansion is utilized. A secondary fast response counter deployment system for canopy ejection is also presented.

The various elements that work together or individually in turn function together in an accumulating efficient manner reducing battery load requirements to operate the vehicle mechanical functions and computer systems. The components and assemblies are described as a prestage gas ejection detector, probe head boot, a strut probe assembly to impart a minimum of downward force, a timed pressure manifold for strut(s) and a strut energy dissipating canopy with chute.

As the prevention of mine accidents is paramount, longer operating times for the mine defeat system are preferred increasing daily service time. Each element described contributes to lowering energy demand and/or vehicle stability.

As the vehicle has its vertical probe assembly attached to the vehicle for clearing mines from a pathway, a strut can be used to provide a downward force. This force is used to drive the reciprocating probe which has the added potential of drawing dynamic energy from its' speed in impacting the ground. A constant pressure control is introduced in a timed manner through the use of the pressure manifold and relay to achieve the lower reaction force when the probe is not in extension mode for each cycle.

The pressure manifold and relay is located in an area away from the containment space. It combines the signaling of the probe head cycle for probe extension with the opening and closing of volume space in the strut(s). The function of controlled volume is provided with the primary feature of strut rod movement. Additional mine detectors will enhance the triggering to dissipation process.

The ability of the machine's probing units to move along will be improved by utilizing carbon fiber or other blast resistant material wrapped around the base of the probe or shoe acting as a flexible boot. A positioning of a mine detector will allow for prestage gas ejection. The probe head assembly may utilize a control ball knuckle for limited directional range of motion.

The placement prevention of mines is simultaneously done in an active format through constant motion and personnel verification using a 360-degree turret to create safe-zones, which is a primary focus for all countries. In each typical village, small areas shall benefit, primarily villages and village connecting trails. Rotation of the camera of 45 degrees to left and right provides 360 degree of coverage with the turret operational. The majority of mines are delivered and set in place by individuals or groups who reside outside the community or village at risk. As an advantage in the self-contained and efficient capabilities, the vehicle is able to continuously perform motion detection and identification checking, through this simple but new effective data gathering technique.

At the rear of the containment plate are mounted three trailing hooks left, center and right. A path marking system for centerline and low spot paint applicator is the last apparatus mounted. Green Energy recharging methods may be assembled in various arrays and modules with concentrating prism lenses to add to the recharging abilities.

As an improvement accessory, where the surrounding terrain requires a better traction, the vehicle has the ability of use of additional flexible tracks to be field installed. Adjustment for width of path utilizing all or any these devices is possible for wider or narrower path requirements.

DRAWINGS

Figures

Figure 1:
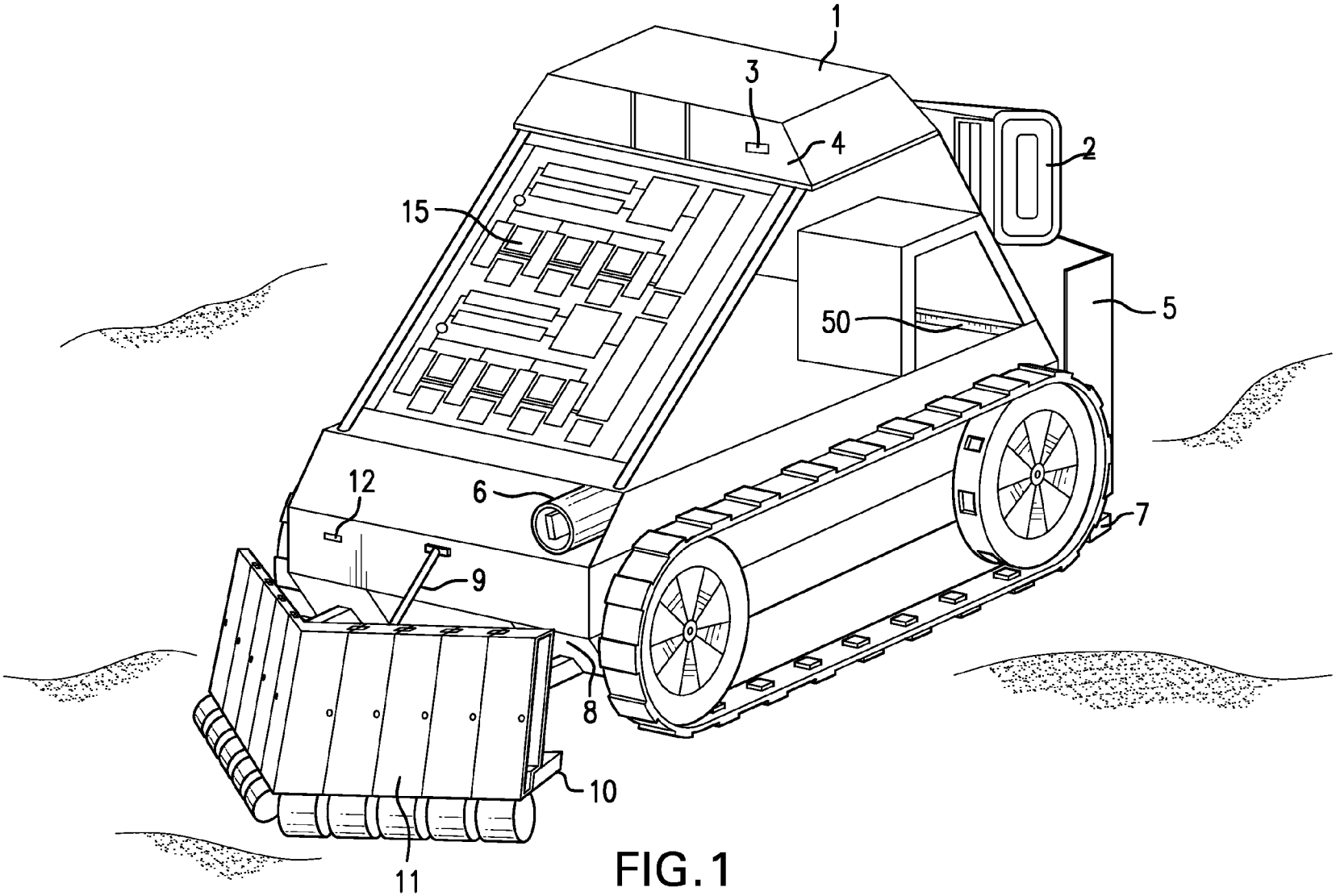
FIG. 1 is a perspective schematic view of a green energy powered minesweeping vehicle according to the preferred embodiment of the invention.

| Drawings - Reference Numerals | |
|---|---|
| 1 | turret |
| 2 | canopy |
| 3 | camera |
| 4 | slide black Box |
| 5 | rear Blast plate |
| 6 | flag deployment system |
| 7 | vertical reciprocating system |
| 8 | concealed robotic arm system |
| 9 | self leveling system |
| 10 | detector |
| 11 | deflector |
| 12 | thermal electric chips |
| 13 | turbines |
| 14 | energy conversion housing |
| 15 | photo voltaic cells |
| 16 | wheels |
| 17 | chassis-body |
| 18 | DC motors |
| 19 | batteries |
| 20 | turret |
| 21 | chassis-body |
| 22 | gas tank system |
| 23 | gas nozzles |
| 24 | gyro |
| 25 | curtain billows |
| 26 | rear blast plate |
| 27 | mounting rod |
| 28 | hinged sliding spline control bracket |
| 29 | strut-cartridge |
| 30 | foil lever |
| 31 | control volume solenoid valve |
| 32 | vertical reciprocating power-head |
| 33 | axial actuator |
| 34 | charge assembly |
| 35 | remote deployable flag |
| 36 | open edge |
| 37 | trigger |
| 38 | anchor base |
| 39 | powder actuated anchor |
| 40 | recoil rod |
| 41 | optional additional anchor base |
| 42 | spring to rod connections |
| 43 | pressure activation lines |
| 44 | pressure system |
| 45 | apron |
| 46 | probe boot |
| 47 | probe shoe mine detector |
| 48 | electromagnetic coils |
| 49 | gas cells |
| 50 | chute |
| 51 | capillary channels |
| 52 | evaporator |
| 53 | condenser |
| 56 | opening |
| 57 | plate surface |
| 60 | shutters |
| 61 | magnification lens |
| 62 | heating chamber |
| 63 | gas reactor |

DETAILED DESCRIPTION OF EMBODIMENTS

As shown in FIG. 1, is a new use non-conventional sized battery powered, solar charged, unmanned vehicle that is sized so as to create a clearing path for people travelling on foot. The first apparatus 11 is the self-leveling debris deflector. The primary chassis contains a solar panel 14 with a high resistant and magnification surface 13. From FIG. 2, a vertical interior section view looking down with the four drive wheels 16 can be found. Inside the chassis 17 are normal DC drive motors 18, current controller means and the battery set 19. The top of the chassis provides space for an optional bio-fuel power-plant that is not necessary but would provide added daily service hours that may be of advantage. In front of the chassis is an optical camera 12 for close in monitoring of operation of robotic arm that is stored in a recessed chamber 8 and for warning flag positioning. Above the chassis is a structural frame, which acts to support the green energy module 14. This panel is secured to the frame with isolation attachments should an event causing toppling occur. The panel surface is damage resistant.

Many types of Green energy sources are possible for energy conversion for power and recharging in the industry's current technology. The differentiating detail noted in the following method is the aspect of energy being created by both solar and gas means for recharging purposes. The system is not limited to energy generation by heat reclamation from internal processes. The following embodiments of green energy use are described in sufficient detail to enable those skilled in the art to practice the invention. One or more multi-stage systems may be used in parallel are contained in a protective housing that is field replaceable as a unit for maintenance or from damage with quick connect frame attachments and energy cables.

Figure 7:
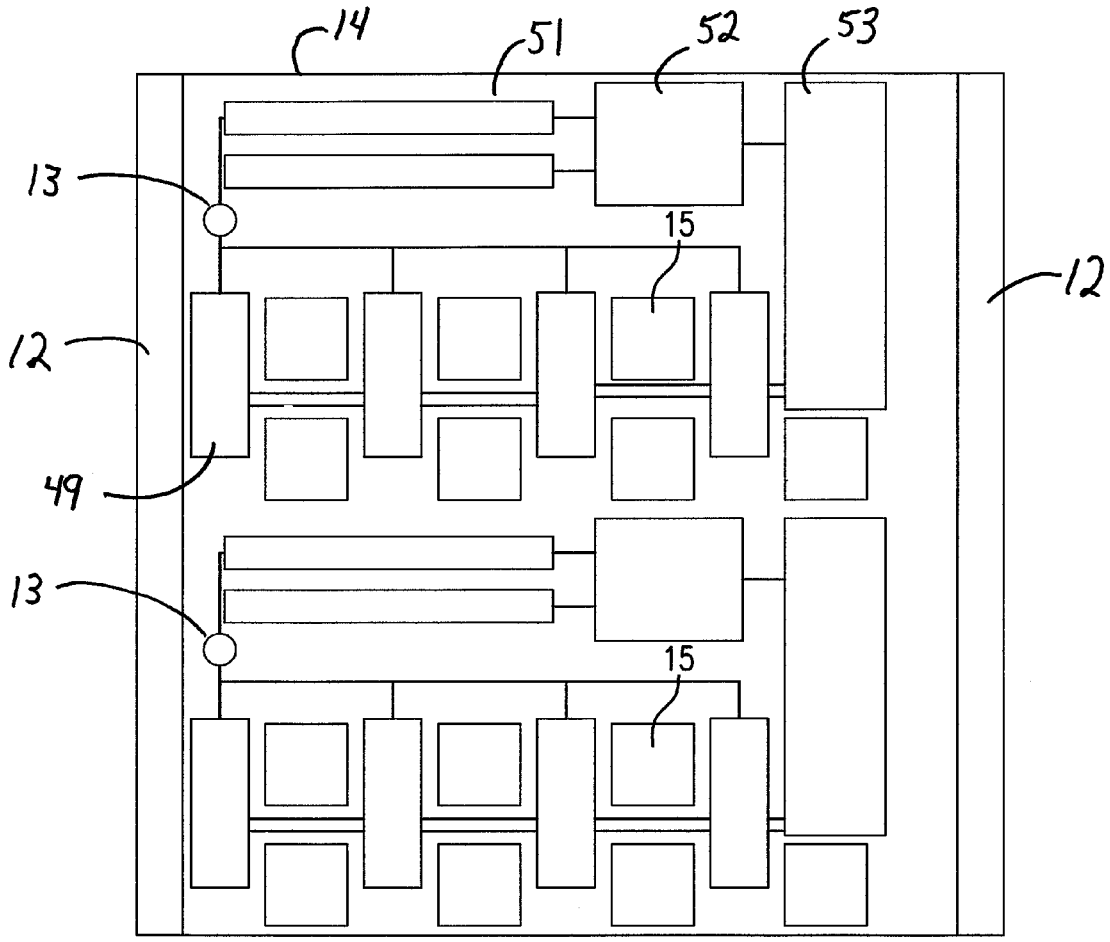
FIG. 7 is a plan schematic depicting the Green Energy Thermal Electric Generator/Gas Reactor Module.

The proposed system, FIG. 7, has the following process to convert both thermal and light energy using sunlight and gas. Contained in a protective container are several elements which transform energy. The simplest form is the photovoltaic cells 15 which may have a magnification prism or lens for intensification. These are distributed in the container around all other elements which are of irregular geometry. They provide immediate voltage from sunlight exposure.

Another electrical generating method contained is a liquid to gas vapor system 63 wherein the vaporized fluid is channeled through a turbine generator 13. The time controlled heating of fluid to gaseous phase is accomplished by a set of shutters 60. A magnification lens 61 focuses sunlight to vaporize the working fluid. One way pressure valves control the flow of fluid in the system from the fluid chamber to the heating chamber 62 through the turbine to the vapor chamber for reliquification.

The working fluid may be methanol, ammonia or acetone although other fluids may be used. The vapor is reliquified in the heat transfer device for use in the system again. The heat dissipation device may include elements such as fins or rods that provide large surface for providing spreading and dissipating heat including volume expansion devices. Other effective means such as capillary channels 51 may be used to improve efficiency for vapor reliquification.

An effective manner of phase change rate is to provide a permeable membrane to make an efficient mass transfer process. The process makes use of capillary transport force acting on the interface of the porous material thereby increasing the rate of vapor venting and removal of corresponding heat flux. A classical evaporator 52 and condenser 53 system may also provide for to maximize the reliquification process.

An additional method for turbine generated energy is included by the introduction of either pure gas such as propane by pressure cylinder vessels or concentrated solid pellets with known dissociation kinetics can create a reaction cell for daily use. The pellets may be of any size which maximizes the liquid gas reaction. The pellet would then combine with an adequate solution and/or catalyst to facilitate the gas expansion phase in the cell. A series of cells forming a cartridge like insert is possible for cell by cell depletion having the individual cells connected into a parallel manifold pipe. Each of the cells having a pressure sensitive orifice disk which ruptures at a predetermined pressure or temperature. Each cell being activated by automated timed sunlight shutters with magnifier lens. Upon depletion of the cells gas concentration, the sunlight shutter is directed towards the next full pellet cell. This pressurized gas then passes through the turbine for additional electric charge. In line flow restrictors control any overpressure. These pure gas methods are utilized by providing a by-pass tube allowing for venting externally away from the evaporator condenser process elements.

The total package delivers an effective optimized combined multi-process for exploiting green energy. The combined Thermoelectric Generator 12/Gas Reactor 63 charging system will allow for longer daily use of the system.

In addition to the previous discussed energy methods for conversion. The current state of the art allows for other various methods of conversion. Additional capabilities may be achieved by the use of hydrogen cell power conversion charging stations. These stations can greatly extend the network and range of coverage for the individual containment robots. Each station would allow for overnight charging which would make the daily duty rating increase. The typical station can be a standalone protected structure for the power generator and containment robot. The primary low demand and low cost continuous refueling requirements would be vessels of water, hydrogen and routine maintenance.

The supporting frame is also a shock cage, which has internally telescoping cylinders for force dampening. Above the shock cage is the turret 1 which is able to swivel horizontally 355 degrees. The turret 1 contains two optical cameras 3, one forward that creates 3D vision when synchronized with the lower chassis camera 12 and one to the rear for real time monitoring and motion detection and verification. Motion to identity security containment and control is accomplished. This significantly protects those registered in the safe zones and residing in the secured areas with personnel and civilians using IC Card verification. A simultaneous process of motion detection with verification of safe zone identification signals is read by computer hardware in the black box 4. Establishing this security process in any area of mine placement activity defends against further mines from being placed. The onboard capacity contains the logistics that would assemble information into a centralized database for use with and for field personnel to access this remote mobile vehicle. Information integration and analysis becomes real time. Verifying ID, document check, and controlling a single identification is extremely crucial as the ease of multiple identities is wide spread. Selective biometric applications involving identification cards containing radio frequency capacity technology for control movement in secured zones. Modernization programs rely on individual identification cards being required to carry. The following soft approach abilities for data gathering are presented for use in an efficient integrated fashion at low cost. Each optical camera is included in a self-contained blast resistant removable black-box 4, one on each side of the turret, which contain operational control and communications integrated circuits and hardware. The turret is also supported from the rear by the back wall, hinged at the top, for additional dampening benefit.

The self-leveling and retractable deflector 11 is illustrated in FIG. 1. Each panel section is slightly angled from the vertical and from the path centerline forward, so as to give a rolling momentum impact force out and away from the path of vehicle. Each panel segment is connected by a simple hinge-pin mounted at mid-panel height. The panels are overlapped so as to create uniform coverage while sloping up or down on the path's surface. From the existing ground surface, tines are placed which act to catch and clear individual stones larger than ¾ inch round in size. The deflector panel assembly is fitted with guide rollers, which produce very little downward force when not mechanically controlled with a height sensor controlled system. The assembly is supported by two side arms that act to maintain a controlled forward projected distance from the chassis and allow for upward rotation retractability when not in use. The total assembly creates a self-leveling effect. Immediately behind deflector panel assembly is mounting table and detection device 9. Within any of the mechanism sections, a canopy may be contained and remotely deployed by any method known in the art. The top of the deflector assembly may have a secondary canopy system mounted over.

The primary countermeasure system is illustrated in FIG. 1 and is a new assembly or unique apparatus for simultaneous triggering and containment of mines. The three features are shown at the rear of the vehicle. The vehicle may work in reverse direction where hazards are extremely high to maximize containment advantages. At the rear of the vehicle a vertical reciprocating system is shown 7, followed by a containment plate 5 and covered by a canopy deployment system 2.

Figure 3:
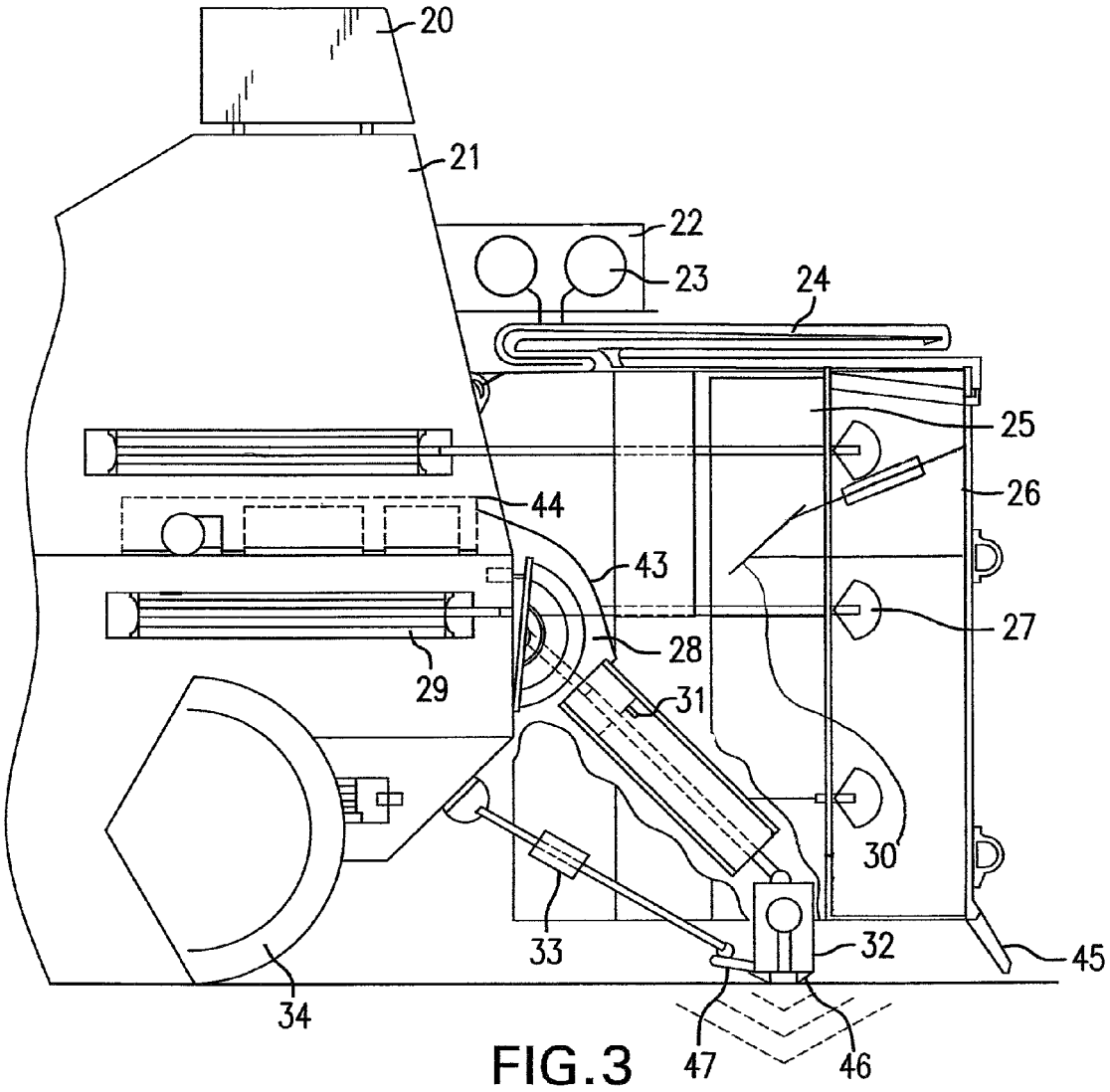
FIG. 3 is a side elevation schematic view depicting the configuration of the mine countermeasure system.

From FIG. 3, the rear of the vehicle can be seen. At the ground surface, each reciprocating foot 32 assembly has a determined width, which applies the appropriate pressure based upon the range of in-situ soil shear strength present where mine detection is to take place. The advantageous feature being created is that the reciprocating system assembly self-propels itself in two distinct ways. First, the individual line of action is inclined a few degrees from vertical, as a foot does. Secondly, the lower control arm has an axial actuator, which has a controlled advance throughout the timed cycle of operation. Each foot has a power head that provides a means of rotation and a controlled variable positive soil displacement, which acts to alter soil at or below surface and accomplish the mine trigger objective by simulating foot pressure and motion. Accomplishing triggering, ignition or downward force may be by any means known in the art which may include, but not limited to, plasma, rollers and electric inductance or electromagnetic means.

The modular, preloaded feet with reciprocating probes are signaled to cycle in a timed fashion for maximizing the net downward force. Downward force for each assembly is provided by a preloaded pressurized strut 30, supported by a vertical spline control bracket 28, which limits horizontal range. The configuration of this apparatus is designed to remain in a horizontal orientation for existing ground undulations of plus or minus three inches and maintain continual ground contact.

From FIG. 3, an improved embodiment may be utilized in the form of a dissipating strut and probe assembly for the clearing of mines from pathways. To ultimately reduce the drag for motion and improve vehicle stability, a plurality of elements are utilized to work together or can be used separately.

In this embodiment for said dissipating struts 30, an improved strut performance can be realized. Each strut utilizes a control volume for manipulating the amount of gas/fluid to be displaced during extension and compression. While the reciprocating function of the probes are under way, the control of downward force is controlled in a cycled manner from a lower pressure value to a timed and synchronized higher value. Both values are able to be controlled by the predetermined size of vessel and the internal rate of displacement from the rod extending or compressing when entering and exiting the strut cylinder. The cycling operation is activated by the use of an internal solenoid valve 31 mounted into the control volume wall which when activated opens and closes the additional internal control volume within the strut chamber. The cycling timing of the solenoid valves is accomplished by the computer or a separate controller which sequences the strut high pressure level with the probe extension.

In another embodiment, a pressure system 44 with accumulator and manifold has pressure activation lines 43 connecting from the dissipating struts to a timed pressure manifold and relay system which combine electrical signals and line energy to open and close manifold valve ports, extend each probe assemblies, being branched and controlled separately to sufficiently cycle the probe extension with high strut pressure in a sequential manner. A controller sends signals to the relay of the manifold and to activate the probes together in a cycled and sequential manner of operation. Activation lines may be energized in an air, electrical and/or hydraulic manner. A combination of the two methods may be utilized for maintaining redundancy and improving reliability.

The strut controls the amount of downward force on the probe head. The overall assembly may be raised or lowered by rotation through a hinge located on the spline bracket and may be by hydraulic means. The spline plate brackets 29 may be used independently for each strut and probe assembly or mounted on a single plate. The movable plates and their positions have a maximum load rating in the extended down operation position that freely release upon detonations by means of a breakaway link, load failure device or other load limiting mechanism that may incorporate an axial piston or other suitably fashioned device to relieve over-pressure. The primary combined feature is a piston lowering the hinged plate and upon a specified overload pressure, the plate rotates closed and simultaneously slides up for a short distance. This combined mechanism and load path creates a deadening effect for the short duration of the pressure wave.

As an alternative, another possible arrangement for the probe head connection and to maintain vertical orientation of the probe action is through the use of a modified connection, a spherically seated control knuckle providing a limited range of rotation. This may allow for more extended use in the field should damage occur. In this embodiment, the base of the strut rod is connected in a vertical plane hinged manner, with a slight degree of out-of-plane deflection possible, to follow the existing ground profile. One embodiment of the connection is to use a control knuckle which has a ball or spherical shape connecting to a similar shaped receiving yoke type socket mounted vertically into the top or side of the probe head surface. The top of either type ball shape used is further guided and controlled in a single vertical plane direction with limited angular range of motion in both rotational directions, accomplished by having a rectangular opening in the top of the socket face and attached to the probe head. The load exerted through such an assembly causes forces to be transmitted normal to the plane, perpendicular to that mounted plane which achieves a desired inherent self-balancing downward force. Said knuckle design may allow for single connection to probe head should damage occur to other links. This forged spindle ball joint has a controlled seat.

The strut assembly may have a critical break-joint design feature to have a planned strut loss to enhance vehicle stability. The break joint may consist of a reduced section of the strut rod or an equivalent means for high load failure. A plurality of mounted dissipating strut assemblies are possible. Each strut assembly may have a pressure limit valve or blow-off for relief of pressure in or on the strut housing for relief activation during the mine event.

To further absorb energy and minimize energy effects, the configuration of certain elements may be introduced and the strut probe head assembly. A unique arrangement of benefit may be utilized. The probe head or other mechanisms may be configured so as to have a slightly cupped face facing towards the imminent blast point. The effect of concentrating a calculated percentage of force through the strut would be directed into the recoil bore assembly. Additionally, a portion of the pressure wave will be redirected. The probe head face plate may have a V shape or other shape to direct forces. To increase the pressure rise time, a layer of viscous material may be added onto the face plate of the triggering mechanism.

The strut assembly having a central rod becomes driven through the strut housing. The strut rod and housing assembly may be conventionally axial in action or be curvilinear and may have a pivot connection. As a method to slow the instantaneous effect of the blast, the strut rod may be made longer to achieve a better time of dampening forces. Absorption of energy is treated as recoil except the gas or fluid orifice pressures would be containing the rod force at the end of its travel acting as a shock isolator. The first rod distance traveled acting as a common shock absorber and after a predetermined overpressure an internal valve would open and the full range of rod travel into a secondary gas or fluid pressure chamber. Any series of orifices, secondary cylinder walls for relief volume may be used to increase the duration of recoil impulse and absorb energy and momentum.

The assembly may have a mounted or body formed muzzle for replaceable reaction charges. The charge may be initiated by a direct connection or signal from the probe of the head assembly to the charge in the breech upon triggering a mine. The reaction of these charges may be of various sizes and will be directed so as to counteract the upward force from the mine onto the machine. Establishing the exact position and direction for this feature will be accomplished by those skilled in the art.

The probe head contains the means for providing a reciprocating probe element. Additional mine detectors will enhance the triggering to dissipation process with an advance signal to start. This may be created by positioning the mine detector sensor on or near to the probe head. In operation, as the machine is in motion, a mine detected or located near to the probe head mine detector sensor 47 sends a feedback loop signal for gas ejection to start a few moments before the probe detonates the mine.

Any type mine detector known to exist and in the art may be attached and located in any position on the vehicle which would assist in the determination of the specific location of below or above ground mines. Mine detectors are commonly located as close to the ground as practicable. Guide roller surfaces may be included in the induction field circuit. Mine detectors may be added at the base of the deflector segments in a variety of connection means such as attachment to the individual deflector segments and probe head shoes through the use of small connection tables, brackets and shelves as well as a more ruggedized, potentially molded integral assembly, whereby the individual parts, such as but not limited to the deflector plate segments, sensors or probe head shoes form an integral, composite or a detachable-attachable assembly. The individual mine detector sensors can be hinged with springs to allow further improved ground clearances, pitch and angle of incidence and be attached by any practicable means known in the art including as a slide or snap on component.

The combined elements of probe head, probe head shoe, probe and prestage detector or parts thereof may be covered for ease of sliding motion over the ground as well as protection, by a flexible carbon fiber or blast resistant material acting as a boot 46 or jacket element for additional guarding against sand and foreign elements. The material of the boot shall be flexible to allow for the repeated probe extension cycles.

The attached mine detector mounted on the front of the vehicle locates mines. As these mines are located, a signal is sent through the feedback loop and are recorded for relative location which also may include positioning by satellite in the on-board computer located in the blackbox. The location of the vehicle is converted into data by two methods. The first is by common GPS positioning. The second is by surveyed range locators that are read by sensors on the vehicle for grid locating and stored on the computer. Other means for determining and storing distance travelled and grid location, along with user remote control exist to those skilled in the art. The blackbox protects these remote controlled, automatic and guidance control features for operation. The machine having possession of this information, along with its inherent motion tracking, calculates by means of computer when the mine shall approach the rear probe assembly with mine detector. As the machine is working its' way forward or backwards and nears the located mine, the gas ejection system is activated at a predetermined time or manually before detonation. Detonation may be accomplished by any of the known methods available known to those skilled in the art.

When the mine detector encounters a mine, an electrical signal is sent to the computer for creating a grid location using known range locators. Satellite positioning data for longitude, latitude and elevation is recorded in the computer. The gas ejection system 23 is started for the release of gas. The gas may be stored in vessels under high pressure in a protective enclosure mounted to the vehicle. The mine detector sensor signals the computer via the feedback loop and activates the solenoid valves or other means of automated valve opening actuation being electronically controlled by the detector sensors or the computer located in the blackbox. The overall operation of the machine is synchronized by the onboard computer using integrated circuits which may be remotely operated. Any means of directing gas common to the art may be used, openings, ports or nozzles to control and direct the flow of gas upward, such as a plurality of ports, outlets, tubes or nozzles which effectively direct the gas jet in the directions desired. Upward directed gas shall deploy canopy and have detonation balancing force and horizontal force to either assist to propel in the forward or rearward direction. Control of gas ejection in any direction is controlled by the computer or remotely for thrust and exhaust velocity. As an example of control of gas, a series of electronically controlled automated valves controlling the gas in each direction can synchronize the control of gas in the desired directions. Other means of gas ejection exist in the art which create sufficient gas ejection and downward force to assist in the counterbalancing of the machine or vehicle before, during and after detonations for improving vehicle stability.

The combined elements of probe head, probe head shoe, probe and prestage detector or parts thereof may be covered for ease of sliding motion over the ground as well as protection, by a flexible carbon fiber or blast resistant material acting as a boot 46 or jacket element for additional guarding against sand and foreign elements. The material of the boot shall be flexible to allow for the repeated probe extension cycles.

The Green Energy Mine Defeat System improved components enhance the performance and stability while reducing maintenance time for longer durations in-service.

In order to improve planar stability, one or more gyroscopes may be employed. A lightweight disk of sufficient weight may be mounted and spun on the structure so as to resist toppling. The axes of rotation shall be set so as to contribute to maintain controlled lift along with roll and topple forces from the event. The action of starting the gyro would commence before and reach full speed before the event. Each Gyro may be supported with isolators of viscoelastic materials or other materials known in the art. The skilled in the art will adjust the global attitude of each gyro assembly to maximize the affect for vehicle stabilization.

Behind the vehicle chassis 21 is a containment blast plate 26, positioned upon status change to encompass the projected inverted conical zone of pressure, fire and fragmentation. Connecting the chassis to the blast plate is one variant of gas-fluid cartridges 29 with stepped release (0-200-800 lbs), which are body to plate connected, used as a dampening struts. The entire assembly is raised and lowered when not in use.

In another embodiment, a foil lever 30 creating a means of combined baffle and absorption are described. Within the stages of shock waves and fragmentation the blastplate is first moved rearward. In milliseconds after this action the pressure wave travels and strikes a plate of normal or curved geometry forming a foil and lever. As the pressure wave impinges upon the foil face it is pushed on the connected energy absorbing struts which are in turn connected to the rear blastplate or other containment space element. This arrangement of a foil lever may be organized in such a way in the containment space in any multiple of times in any suitable arrangement to maximize energy absorption. At the leading face of these foil levers may include a suitable face to reduce velocity to subsonic speeds. The foil angle may be adjusted at any angle to manage forces that will contribute to balancing the overall stability of the machine.

The billows 25 and curtain 25 are attached and assembled in accordion like manner on and along the sides of the containment space. The canopy 24 is attached in a folded parachute manner. Both are of a blast resistant material such as carbon fiber or better. As the mine is triggered, the blast plate and vehicle are lifted and sent in different directions. The blast travel distance is slightly less in distance to the blast plate 26. Therefore, initially causes a reverse direction of the total assembly. Through this action and the gas-fluid cartridges 29, energy is dissipated with a reaction being centrally resisted by the mass and size of the reciprocating system.

As those reciprocating system parts that are in ground contact and as a reaction to the mine detonation, a feedback loop is broken and a fail safe signal located along the feet is tripped on, when the connection is broken. The connecting arms are limit rated and are subject to the first and highest levels of stress. Upon the signal being sent to the optional gas ejection system 22, a propelled inert gas and fire suppression 23 system is activated for canopy deployment in an upward and reverse impulse direction. The canopy chute 24 path and speed is maximized upward for containment and canopy deployment from the top of assembly. A conventional set of three trailing hooks, left, center and right edges of the rear containment plate of the vehicle are employed to activate underground trigger mechanisms for offset hazards of above-ground, concealed mines.

In another embodiment, the canopy may have an intermediate or top section that is modified to mitigate the resulting pressure, fire and fragmentation. In this arrangement a single or multiple series of rectangular rings consisting of extensible rods, corner bars, and struts are used to form a strut ring. Other shapes to establish containment strut rings such as ovals, triangles, circles, polygons or curvilinear outlines are also possible. The resultant grouping from pressure wave reactions are established, the corresponding best shape fit which best dissipates the shock, pressure wave and fragmentation event.

The corners of the rectangle form reaction points. The corners have connectable ends which are able to make connection with pressure relieving struts 29, which may be telescopic. These components may be either for multiple use or replaceable. The principle of use is that the rectangles form a frame that the blast resistant material is connected onto in a billows curtain 25 method and the curtain is so connected, possibly unevenly pleated, from side to side, so as to slide along the lengths of the rectangle ring sides into a fully expanded manner. Therefore, as the canopy rectangle is propelled upward and subjected to any force, it has the ability to expand and be subjected to the stress and strain in the horizontal plane through the struts along the respective sides and further being contained by the expanding billows curtain sides. The unfolding nature of the canopy with the rectangular frames with struts included as described have the ability to be stacked in repetition.

As a later stage failsafe method of energy dissipation and to reduce the number of elements involved for energy dissipation, a top canopy breakaway section may be used. The principle of locating fragmentation baffles before top liftoff would provide a means of relieving overpressure with an overall smaller canopy.

A chute 50 may be introduced into the vehicle or robot chassis as a possible arrangement for gas and pressure flow. Chutes, Foils, tension bands and baffles are positioned to have the greatest effect to deflect and absorb energy and fragmentation.

A blast gate for any chute may be positioned at the entrance of a chute or foil. The gate acts as an initial pressure wave brake resisted by energy absorbing struts mounted to the gate plate and to the containment space. The gate orientation may be positioned so as to cause reactions from the pressure wave into the machine so as to absorb or contribute to stabilization. The chute may have a foil inside for reaction from lift. The concept of blast through structure provides for possibility of minimization of event reaction forces.

In a separate embodiment, a combined complementing element may be employed for vehicle and machine stabilizing and absorption requirements. As the triggering takes place, staged reactions are started and the pressure wave comes into contact with the mechanisms. In order to further dissipate the energy from the leading shockwave, a magneto flux sandwich system FIG. 10 may be used.

The pressure wave acting upward and outward reacts against any surface in proximity. The containment space so proportioned with triggering mechanisms present, create contact surfaces. The net result is to cause instability and overturning to the vehicle or robot machine. In aim to balance all forces, it is advantageous to compensate for these forces. A series of high strength conductive plates 57 may be arranged in a sandwich configuration for an immediate impulse reaction. These sandwich assemblies may be sized, shaped, arranged and hinged in multiple positions in the containment zone so as to maximize energy dissipation and deflection. The entire assembly configuration may be fixed or shock strut connected to the vehicle or machine. Formations imparting couples into the frame may be realized.

The system power source may be by an onboard generator and assisted from a gyro fitted for current generation. A current field is generated and wired to the system. The system comprises two or more rigid or semi rigid plates with conductive strips, poles or surfaces 48 for providing current field induction. Permanent magnets may be incorporated into the plate surface. Each surface is connected so as to allow limited freedom of movement out of plane as well as in plane, each surface forming a plate that has any array of openings.

The complimentary offset plate or surface has a mated array of openings which may contain an inverted or planar opposite set of shaped ducts. The planar angle of each duct may be of any angle so as to maximize the effect of pressure wave reduction. As a second stage to the system, the surfaces or plates may be conductive so as create a magnetic field for attractive or repulsive force which may be from permanent magnets or electromagnetic means. The magnetic field and corresponding magnetic flux may be varied and is provided at a desired strength for resistance, opening and or closing and may be area attenuated. The plate movement action may be actuated from voltage from a capacitor source. The plates may be layered with dielectric material so as to maximize repulsion and attraction effects. The plates may be held at a distance relative to another mechanically. Each plate may have any percentage of surface area open for pressure wave passage.

In one reaction case, the pressure field strikes the first plate and is pressed towards the secondary plate. As this motion takes place the magnetic field between the two plates is turned on, the plates acting into the direction of the pressure wave. In another reaction case, a second plate, having complimentary meshed ducts, is repulsed with sufficient flux density. As the pressure wave impacts the primary front plate the magnetic field is closed and the plates slam together. In both cases the opening or closing of the plates with the corresponding openings and ducts deflects and diverts pressure wave forces. Further reaction force can be provided by the use of pressure sensitive encased charges 34 at the bottom of each port stub. The total amount of reaction force can be staged to react to the uplift force encountered.

Leading edges of surfaces and openings may have modified ridges for drag and velocity reduction. A plate may have no openings. A third plate may be sandwiched for additional deflecting effects. In order to improve the plate deflection characteristics, the use of baffles creating a leading drag layer of suitable material strength may be placed in front of the plates. Sensors, pressure transducers and relays may be used to control any advance or delay required to optimize controlling change of the flux density of the magnetic field in the system.

The combined components are so arranged to dissipate the energy field with respect to its vector and by stage of the mine event and respond in a predetermined and controlled manner. A split blast plate with pressure struts can be used. As is the case with many structures that may encounter pressure waves, dissipating, collapsible and compressible medium in layers may contribute to protection of the intended space and surfaces or vacuum control volume may be incorporated on the surfaces or within the containment space in order to mitigate forces to be resisted or deflected. Each of the absorbing elements and mechanism are positioned and analyzed in a global vector summary around the machine centroid to arrive at the best use to resolve the set of forces to achieve overall stability.

A centerline path marking system mounted at the rear containment plate is provided whereby a path centerline is prepared with wheel brush and air system and marking with specialized material/paint at coded spaced intervals. The system also automatically paints low spots and where not proofed, unchecked or for skipped locations.

Figure 4:
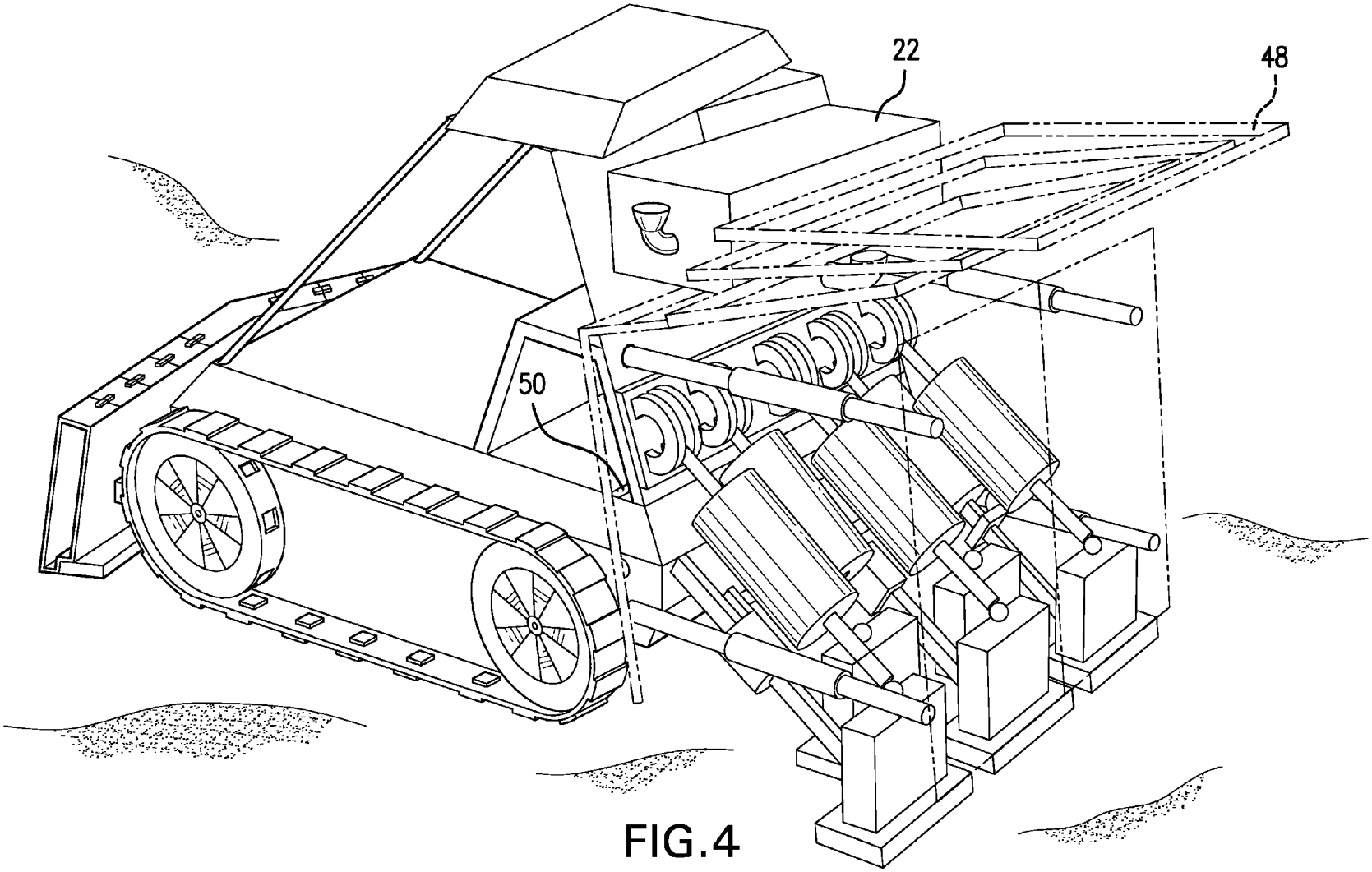
FIG. 4 is a perspective schematic view of a powder actuated warning flag.

FIG. 1 shows the warning flag tube 6 mounted on the top of the vehicles chassis. FIG. 4 illustrates the detail for the self-contained, remote deployed warning flag system. The vehicle carries a remote deployed powder actuated anchored unfolding warning flag 4 in the top or on the side of the lower chassis body. At this location or mounted onto the side of the chassis a single to several warning flags tubes can be stored. This self-contained function allows the administration of possible deactivation or detonation to be controlled in a more efficient manner in addition to keeping personnel involvement to a minimum for marking the hazard by remotely placing near to located hazards.

The individual flag 35 becomes upright when removed from tube and expand automatically with the individual sides being of flexible spring-to-rod 42 connections. Upon locating the anchor base 38 to its desired location by the operator, the base is positioned and trigger 37 discharged by the use of the robotic arm, securing it into the ground by the powder actuated anchor 39 making the flag spiked into the ground. An additional automatic trigger for discharge may be used at the far base location 41. To aid in the ability to weather wind conditions, the top and base are vented 36 & 40 open to reduce blow over affect.

Through the progress of technology, the geometry and configuration of machine structure and components may be more streamlined and efficient. This process of development may include the energy dissipation, force balancing and containment elements being located anywhere in or through the structure, possibly within the wheelbase. The methods stated herein apply science and engineering result in a planned staged dynamic hysteresis through a vehicle, machine, robot or structure with mechanisms, methods and devices to detect, trigger and/or absorb energy of a mine and resulting blast shockwave and contain fragmentation.

The invention has been described with respect to particular embodiments, modifications and substitutions within the spirit and scope of the invention and will be apparent to those of skill in the art that individual elements identified herein as belonging to a particular embodiment, may be included in other embodiments of the invention as well. The present invention may be embodied in other specific forms without departing from the attributes herein described. The illustrated embodiments and examples of use should be considered in all respects as examples and illustrative and not restrictive. The devices described herein, individually or in combination may be advantageously be fixed as attachments for or onto other vehicles to achieve desired results which are needed.

I claim:

1. An apparatus on a vehicle or robot for containing landmine blasts, comprising:

a plurality of energy dissipating struts mounted to said vehicle or robot and at least one blast sandwich assembly, wherein said struts are energy absorbing and connected on one end to said vehicle or robot and on the opposite end to said blast sandwich assembly;

the blast sandwich assembly having two or more blast resistant plates with space between said plates and at least one said plate having multiple openings;

said plate openings having internally aligned ducts suitably fashioned to deflect energy;

and wherein said plates are connected at edges.

2. The apparatus of claim 1, wherein said plates have a distance in space between said plates controlled by electromagnetic forces and are hinge connected at edges.

3. The apparatus of claim 1 wherein energy absorbing material is layered onto one or more of said plate surfaces.

4. The apparatus of claim 1, 2 or 3, wherein two or more of said blast sandwich assemblies further comprise forming a larger surface wherein said blast sandwich assemblies are hinge connected to each other.

5. The apparatus of 1 or 2, wherein at least one said blast sandwich assembly is hinged to open as a gate.

6. The apparatus of 1 or 2, further comprising pressure sensitive encased charges positioned to counteract upward forces from said mine blast.

7. The apparatus of 1 or 2, wherein said robot contains a gyroscope.

8. The apparatus of 1 or 2, wherein said robot contains one or more chutes through said robot.

9. The apparatus of 1 or 2, wherein said robot comprises a frame having telescopic cylinders supporting a turret.

10. The apparatus of 1 or 2, wherein said robot comprises an on-board computer for user remote control.

11. The apparatus of 1 or 2, wherein said robot comprises an on-board computer using global positioning satellite positioning for automatic guidance control operation.

* * * * *

UNITED STATES PATENT AND TRADEMARK OFFICE

CERTIFICATE OF CORRECTION

PATENT NO. : 9,234,725 B2
APPLICATION NO. : 13/754317
DATED : January 12, 2016
INVENTOR(S) : Diaz It is certified that error appears in the above-identified patent and that said Letters Patent is hereby corrected as shown below:

Please delete Patent 9,234,725 in its entirety and insert Patent 9,234,725 in its entirety as shown on the attached pages Signed and Sealed this
Seventh Day of June, 2016

Michelle K. Lee

Michelle K. Lee
*Director of the United States Patent and Trademark Office*

(12) United States Patent
Diaz

(10) Patent No.: US 9,234,725 B2
(45) Date of Patent: Jan. 12, 2016

(54) FORCE PROTECTION AND MOBILITY MODULES FOR BREACHING ROBOT

(71) Applicant: Kevin Mark Diaz, Dorchester, MA (US)

(72) Inventor: Kevin Mark Diaz, Dorchester, MA (US)

( * ) Notice: Subject to any disclaimer, the term of this patent is extended or adjusted under 35 U.S.C. 154(b) by 275 days.

(21) Appl. No.: 13/754,317

(22) Filed: Jan. 30, 2013

(65) Prior Publication Data

US 2014/0007756 A1 Jan. 9, 2014

Related U.S. Application Data

(63) Continuation-in-part of application No. 13/538,068, filed on Jun. 29, 2012, now Pat. No. 8,677,876, which is a continuation-in-part of application No. 13/184,505, filed on Jul. 16, 2011, now Pat. No. 8,240,239.

(51) Int. Cl.

| | |
|---|---|
| ***F41H 7/04*** | (2006.01) |
| ***F41H 11/16*** | (2011.01) |
| ***F41H 11/13*** | (2011.01) |
| ***F41H 7/00*** | (2006.01) |
| ***F41H 5/20*** | (2006.01) |
| ***F41H 5/007*** | (2006.01) |
| ***F41H 5/06*** | (2006.01) |
| ***F41H 11/00*** | (2006.01) |
| ***F41H 11/18*** | (2011.01) |
| ***F41H 11/28*** | (2011.01) |

(52) U.S. Cl.

CPC ..... *F41H 11/13* (2013.01); *F41H 5/007* (2013.01); *F41H 5/06* (2013.01); *F41H 5/20* (2013.01); *F41H 7/005* (2013.01); *F41H 7/042* (2013.01); *F41H 11/00* (2013.01); *F41H 11/16* (2013.01); *F41H 11/18* (2013.01); *F41H 11/28* (2013.01)

(58) Field of Classification Search

CPC ..... F41H 5/013; F41H 5/02; F41H 5/04; F41H 5/023; F41H 5/14; F41H 5/16; F41H 7/04; F41H 7/00; F41H 7/048

USPC ..... 89/1.13, 36.01, 36.02, 36.07, 36.08, 89/36.09; 102/402; 86/50

See application file for complete search history.

(56) References Cited

U.S. PATENT DOCUMENTS

| | | | | |
|---|---|---|---|---|
| 2,005,392 | A * | 6/1935 | Remus | 37/274 |
| 2,419,308 | A * | 4/1947 | Ellsworth | 89/1.13 |
| 3,152,442 | A | 10/1964 | Rowekamp | |
| 3,820,479 | A * | 6/1974 | Fylling | 109/1 R |
| 3,837,259 | A * | 9/1974 | Vaughn | 89/1.13 |
| 4,036,104 | A * | 7/1977 | Pagano | F41H 7/04 89/36.02 |
| 4,467,694 | A * | 8/1984 | Azulai et al | 89/1.13 |

(Continued)

FOREIGN PATENT DOCUMENTS

| | | | | |
|---|---|---|---|---|
| DE | 3820479 | A1 * | 2/1989 | A22C 5/00 |
| EP | 1705452 | A1 * | 9/2006 | F41H 5/013 |

*Primary Examiner* — Benjamin P Lee

(57) ABSTRACT

Systems and Apparatus are presented to establish Mobility Capability and provide Force Protection Capabilities for military forces and civilians permitting the abilities of movement and advance without delay. Each of the technology's components has synergy allowing mobile Fragmentation Protection to lead troops on missions. Additionally, devices may be used in different configurations to field various detection, neutralization and fragmentation protection needs with various levels of shockwave absorption. This Technology synchronizes Operations for robots or vehicles with Dismounted Warfighter Force Protection.

11 Claims, 11 Drawing Sheets

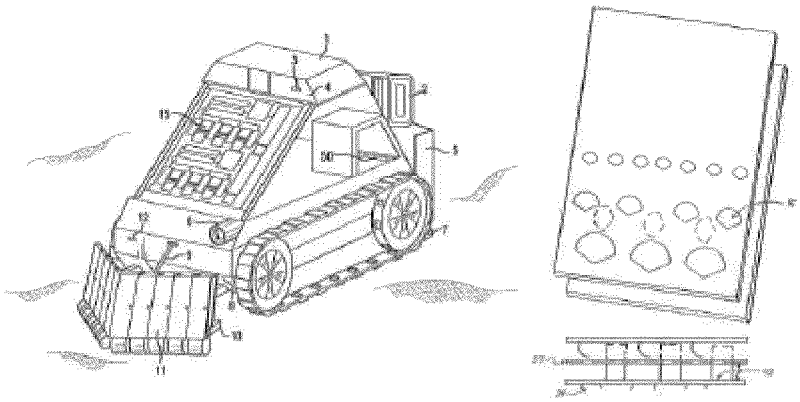

(56) References Cited

U.S. PATENT DOCUMENTS

| | | | | | |
|---|---|---|---|---|---|
| 4,552,053 | A * | 11/1985 | Bar-Nefy et al. | 89/1.13 | |
| 4,585,387 | A * | 4/1986 | Jayne | 414/730 | |
| 4,621,562 | A * | 11/1986 | Carr et al. | 89/41.05 | |
| 4,674,048 | A | 6/1987 | Okumura | | |
| 4,716,810 | A * | 1/1988 | DeGuvera | F41H 5/013 | 109/83 |
| 4,727,940 | A * | 3/1988 | Bar-Nefy et al. | 171/84 | |
| 4,901,644 | A * | 2/1990 | Nevins et al. | 102/293 | |
| 4,919,034 | A * | 4/1990 | Firth | 89/1.13 | |
| 4,932,831 | A * | 6/1990 | White et al. | 414/732 | |
| 4,938,114 | A * | 7/1990 | Matthews et al. | 89/1.13 | |
| 5,033,357 | A * | 7/1991 | Seksaria | F16B 5/0233 | 403/167 |
| 5,097,911 | A * | 3/1992 | Kendall | 172/815 | |
| 5,125,317 | A * | 6/1992 | Spektor et al. | 89/1.13 | |
| 5,237,468 | A * | 8/1993 | Ellis | 360/92.1 | |
| 5,263,809 | A * | 11/1993 | Kent | 414/680 | |
| 5,307,272 | A * | 4/1994 | Butler et al. | 700/90 | |
| 5,410,944 | A * | 5/1995 | Cushman | 91/520 | |
| 5,570,992 | A * | 11/1996 | Lemelson | 414/744.3 | |
| 5,576,508 | A * | 11/1996 | Korpi | F41H 5/013 | 89/36.01 |
| 5,648,901 | A * | 7/1997 | Gudat et al. | 701/23 | |
| 5,712,441 | A * | 1/1998 | Grunewald | 89/1.13 | |
| 5,786,542 | A * | 7/1998 | Petrovich et al | 89/1.13 | |
| 5,856,629 | A * | 1/1999 | Grosch et al. | 89/1.13 | |
| 5,869,967 | A * | 2/1999 | Straus | 324/326 | |
| 5,892,360 | A * | 4/1999 | Willer et al. | 324/326 | |
| 5,936,185 | A * | 8/1999 | Tokuni | 89/1.13 | |
| 5,988,037 | A * | 11/1999 | Haughom et al. | 89/1.13 | |
| 6,113,343 | A * | 9/2000 | Goldenberg et al. | 414/729 | |
| 6,302,100 | B1 | 10/2001 | Vandenberg | | |
| 6,343,534 | B1 * | 2/2002 | Khanna et al. | 89/1.13 | |
| 6,377,872 | B1 * | 4/2002 | Struckman | 700/258 | |
| 6,393,959 | B1 * | 5/2002 | Amemiya | 89/1.13 | |
| 6,681,675 | B2 * | 1/2004 | Miller | 86/50 | |
| 6,809,520 | B1 * | 10/2004 | Nelson | 324/329 | |
| 6,879,878 | B2 * | 4/2005 | Glenn et al. | 700/245 | |
| 7,152,517 | B1 * | 12/2006 | Ivey | B63G 9/02 | 114/240 B |
| 7,198,112 | B2 * | 4/2007 | Wanner | 172/19 | |
| 7,228,927 | B2 * | 6/2007 | Hass et al. | 180/65.25 | |
| 7,296,503 | B1 * | 11/2007 | McGrath | 89/1.13 | |
| 7,411,337 | B2 | 8/2008 | Tadayon | | |
| 7,458,306 | B2 * | 12/2008 | Singh | F41H 7/04 | 89/36.02 |
| 7,493,974 | B1 * | 2/2009 | Boncodin | 180/2.2 | |
| 7,540,540 | B2 * | 6/2009 | Kwon et al. | 285/411 | |
| 7,565,941 | B2 * | 7/2009 | Cunningham | 180/167 | |
| 7,600,460 | B2 * | 10/2009 | Manders | 89/1.13 | |
| 7,683,821 | B1 * | 3/2010 | Clodfelter | 342/22 | |
| 7,712,405 | B2 * | 5/2010 | Toycen et al. | 86/50 | |
| 7,740,082 | B2 * | 6/2010 | Davidson et al. | 171/18 | |
| 7,752,953 | B2 * | 7/2010 | Sokol et al. | 89/1.13 | |
| 7,775,146 | B1 * | 8/2010 | Bitar et al. | 89/1.13 | |
| 7,884,569 | B2 * | 2/2011 | Ward | 320/101 | |
| 7,958,809 | B1 * | 6/2011 | Bitar et al. | 89/1.13 | |
| 7,987,760 | B1 * | 8/2011 | Lundquist et al. | 89/1.13 | |
| 8,004,816 | B1 | 8/2011 | Adler | | |
| 8,234,965 | B2 * | 8/2012 | Ravid et al. | F41H 5/0492 | 109/49.5 |
| 8,409,513 | B2 | 4/2013 | Miller | | |
| 8,499,675 | B2 | 8/2013 | McCabon et al. | | |
| 8,539,873 | B2 * | 9/2013 | Gonard et al. | F41H 5/023 | 89/36.01 |
| 8,578,831 | B2 | 11/2013 | Adler et al. | | |
| 2005/0257677 | A1 * | 11/2005 | Ravid et al. | F41H 5/013 | 89/36.02 |
| 2008/0236376 | A1 * | 10/2008 | Reeves et al. | 89/1.13 | |
| 2009/0223355 | A1 * | 9/2009 | Manders | 89/1.13 | |
| 2009/0250276 | A1 * | 10/2009 | Goodwin et al. | 180/65.265 | |
| 2010/0275472 | A1 * | 11/2010 | Cunningham | 37/403 | |
| 2011/0259181 | A1 * | 10/2011 | Lundquist et al. | 89/1.13 | |
| 2012/0125182 | A1 * | 5/2012 | Lundquist et al. | 89/1.13 | |
| 2012/0137866 | A1 * | 6/2012 | Gonard et al. | F41H 5/013 | 89/36.08 |
| 2012/0152101 | A1 * | 6/2012 | Engleman | F41H 5/026 | 89/36.08 |
| 2012/0210854 | A1 * | 8/2012 | Bitar et al. | 89/1.13 | |

* cited by examiner

FORCE PROTECTION AND MOBILITY MODULES FOR BREACHING ROBOT

BACKGROUND

Prior Art

The following is a tabulation of some prior art that presently appears relevant:

| U.S. Patents | | | |
|---|---|---|---|
| Pat. No. | Kind Code | Issue Date | Patentee |
| 7,493,974 | B1 | 2009 Feb. 24 | Boncodin |
| 5,856,629 | | 1999 Jan. 05 | Grosch et al. |
| 6,343,534 | B1 | 2002 Feb. 05 | Khanna et al. |
| 2,005,392 | | 1933 Apr. 18 | Remus |
| 4,589,341 | | 1986 May 20 | Clark |
| 4,519,543 | | 1985 May 28 | Szuminski |
| 6,216,740 | | 2001 Apr. 17 | Bunya |

This application is a Continuation-In-Part of application Ser. No. 13/538,068, filed Jun. 29, 2012 now U.S. Pat. No. 8,677,876 which is a Continuation-In-Part of application Ser. No. 13/184,505, filed Jul. 16, 2011 now U.S. Pat. No. 8,240,239.

This invention relates to a green energy, battery powered, unmanned mine defeat vehicle. Current situations in specific geographic regions of the world have created a new need for defeating underground mines in desert-like terrain. This vehicle is especially to be used on existing paths in sand environments worldwide to protect against death and dismemberment, a long-time priority issue and establishes an effective tool for safe passage and security monitoring and creating secure zones. Both the facts of presence of underground mines as well as the importance of deterrence and prevention of positioning new mines are widely available to individuals. The necessity for addressing the issue of travel protection by foot on paths consisting of bare ground is the focus of the new vehicle as presented. The invention has the advantage of operating with Green Technology only and in areas that do not have conventional AC (alternating current) for charging or common petroleum based fuel sources for conventional gas engines.

The unfilled need for defeating mines in environments such as opens fields, village passages and trails between villages has always needed a method of solution. As the use of mines was common for numerous years, millions of mines are located and placing an equivalent number of humans at risk. Many green energy powered vehicles exist but do not comprehensively address mines. Many methods exist for the protection from mines for personnel vehicles. Recent studies have indicated that a new degree of effort must be made spent into the success of what is first step to defeat of mines, that of limiting the placement of them. Thus creating the benefit of secure areas. Proactive security and containment is simultaneously performed as the vehicle functions to prevent further placements of mines.

In order to connect rural areas for trade, commerce, travel and ensure village stability, establishing and maintaining safe pathways is a central strategic objective. So as to achieve this objective in harsh environments and terrain this mobile platform facilitates missions making logistically supportable operations to provide security. This will provide a new force element for establishing and for continued physical security within and between villages or in developing areas. Integrating existing and future screening programs allows for more comprehensive and safer processes. In becoming part of the force structure, this equipment adds function and strength to achieve current and future missions. With basic instruction for operation, communication skills, improvised explosive device detection, biometric identification and checkpoint procedures the defeat system participates by providing simultaneous combined activities. The necessity of having a capable defensive security underlies the ability of a village to protect and sustain itself. Villager and soldier perceptions of security are an important contributing health factor as the nuance of safety is required for stability and growth in the area. The robot machine would integrate well working forward in platoon and squad sized forces. Additional consideration is given toward the positive contributions provided in riot conditions to monitor, assess, contain, capture and control situations which are in areas of immediate importance.

Several types of solar vehicles and minesweepers for detection and destruction of mines are known, each with a disadvantage. Many solar powered vehicles exist but do not comprehensively address mines. Many methods exist for the protection from mines for personnel vehicles and utilizing unmanned robots. The previous patent for a solar vehicle U.S. Pat. No. 7,493,974 to Boncodin is for human transportation. A minesweeping vehicle, U.S. Pat. No. 5,856,629 granted to Grosch et al. is for wide-open spaces. The U.S. Pat. No. 6,343,534 to Khanna et al utilizes many latest methods for detection without a simultaneous in place trigger and containment system or marking process. The previous U.S. Pat. No. 2,005,392 to Remus addresses the use of a deflector with the disadvantage of flat surface use only. U.S. Pat. No. 4,589,341 to Clark discusses a chute but is for foam use. The U.S. Pat. No. 4,519,543 to Szuminski describes nozzles on a jet aircraft. The patent of Bunya, U S. Pat. No. 6,216,740 acts to only control the manifold operation.

This application is a Continuation-In-Part of application Ser. No. 13/538,068, filed Jun. 29, 2012 now U.S. Pat. No. 8,677,876 which is a Continuation-In-Part of application Ser. No. 13/184,505, filed Jul. 16, 2011 now U.S. Pat. No. 8,240,239. This invention improvement relates to the assemblies for use where economy of energy must be achieved for the controlled pressure application, dissipation and vehicle stability for the mine defeat system. There are several elements which are additive and independent included for various levels of performance. The particular machine described in the application is presented in its best mode for a single pathway clearing system as described in this specification. Synergy exists in the assembly of apparatus by first being blast triggered by the closer initial offset distance towards the mounted blast plate at the rear of assembly which is strut mounted to the vehicle platform. The pressure field is relieved and dissipated by the system of energy absorbing struts, billows curtains and expanding canopy. The machine reacts as the pressure is relieved in the pressure wave direction and each side functioning as a dissipating containment system.

This equipment clears a minimum, substantial 32 inch wide path, for personnel in single file traversing pathways with detection, verification, sensors, surveillance, disarming, detonation, containment and path marking all in one process. This method of defeating a mine keeps people and personnel at a distance from the hazard with prevention, simultaneously. Pressure wave, fire and fragmentation from all mines occur within milliseconds of triggering the device and it is necessary to defeat this type of device from placement to containment, specifically anti-personnel type mines. The one vehicle makes available the necessary functions of soft protection methods and direct mechanized means. This addresses the two-part problem of mines, protection from initial placement while also providing safe detection, removal and containment, a combined comprehensive approach to defeating mines.

SUMMARY

It is the objective of the present invention to create a new use for a combined powered vehicle to provide an improved combined compact mine detector, monitor and sweeper and containment apparatus in the most austere environments to run as conventional fuel driven power or using Green Technology. The vehicle is a battery based DC (direct current) motor drive recharged with a green energy module attached onto the forward sloping frame. It does not require daily fueling. Introducing equipment that is designed to be small in size and intended to be durable and cost sacrificial utilizing mechanical and detection means having the advantage of self-contained capabilities. The goals and approach are solely based on control of spaces at risk to mine placement and provide a cost-effective, high performance solution with known survivability limitations and budget-sacrificial equipment loss and only life saving and casualties reduction made as a variables of measured value.

Operation speed and maneuvering including tight turning is afforded by the fact of equal wheel base to track width yielding nearly a zero turning radius. Any of the customary control methods are possible, including remote or wired joystick as leader-follower arrangement, satellite, or run automatically on memory-learned pathways for routine path mine checking.

Common current field practice operating unmanned vehicle involves avoiding and maneuvering around debris and small stones and rocks, which lay in a path between two points of the objective route. A deflector that has multiple panel segments may naturally track downward onto the existing path cross-section. The deflector may be counterweighted. The assembly may retract for protection during deactivation attempts or detonation.

A remote retractable robotic arm is deployed to execute disarming when desired. An air tube routed to the deflector base from the gas ejection system is a tool for air blasting sand to uncover mines. Optional sensors read incoming path profile and controls deflector and the probe assembly. The feedback loop created maintains a telemetry system for all ground sensors. Procedure also may include sidestepping mine and installing a flag for the affected area.

For normal conditions, the vehicle travels and a simultaneous area proofing and fragmentation protection system operates, a new countermeasure for field use. A specifically arranged configuration and assembly for replicating foot motion and pressure with a compound articulating mechanism is employed. A controlled pressure (0 to 30 psi) vertical reciprocating system for mine activation is utilized for positive soil contact and pressure to be delivered across the width of the vehicles pathway. A curtain billows, plate and canopy system for detonation dampening for expansion is utilized. A secondary fast response counter deployment system for canopy ejection is also presented.

The various elements that work together or individually in turn function together in an accumulating efficient manner reducing battery load requirements to operate the vehicle mechanical functions and computer systems. The components and assemblies are described as a prestage gas ejection detector, probe head boot, a strut probe assembly to impart a minimum of downward force, a timed pressure manifold for strut(s) and a strut energy dissipating canopy with chute.

As the prevention of mine accidents is paramount, longer operating times for the mine defeat system are preferred increasing daily service time. Each element described contributes to lowering energy demand and/or vehicle stability.

As the vehicle has its vertical probe assembly attached to the vehicle for clearing mines from a pathway, a strut can be used to provide a downward force. This force is used to drive the reciprocating probe which has the added potential of drawing dynamic energy from its' speed in impacting the ground. A constant pressure control is introduced in a timed manner through the use of the pressure manifold and relay to achieve the lower reaction force when the probe is not in extension mode for each cycle.

The pressure manifold and relay is located in an area away from the containment space. It combines the signaling of the probe head cycle for probe extension with the opening and closing of volume space in the strut(s). The function of controlled volume is provided with the primary feature of strut rod movement. Additional mine detectors will enhance the triggering to dissipation process.

The ability of the machine's probing units to move along will be improved by utilizing carbon fiber or other blast resistant material wrapped around the base of the probe or shoe acting as a flexible boot. A positioning of a mine detector will allow for prestage gas ejection. The probe head assembly may utilize a control ball knuckle for limited directional range of motion.

The placement prevention of mines is simultaneously done in an active format through constant motion and personnel verification using a 360-degree turret to create safe-zones, which is a primary focus for all countries. In each typical village, small areas shall benefit, primarily villages and village connecting trails. Rotation of the camera of 45 degrees to left and right provides 360 degree of coverage with the turret operational. The majority of mines are delivered and set in place by individuals or groups who reside outside the community or village at risk. As an advantage in the self-contained and efficient capabilities, the vehicle is able to continuously perform motion detection and identification checking, through this simple but new effective data gathering technique.

At the rear of the containment plate are mounted three trailing hooks left, center and right. A path marking system for centerline and low spot paint applicator is the last apparatus mounted. Green Energy recharging methods may be assembled in various arrays and modules with concentrating prism lenses to add to the recharging abilities.

As an improvement accessory, where the surrounding terrain requires a better traction, the vehicle has the ability of use of additional flexible tracks to be field installed. Adjustment for width of path utilizing all or any these devices is possible for wider or narrower path requirements.

DRAWINGS

Figures

FIG. 1 is a perspective schematic view of a green energy powered minesweeping vehicle according to the preferred embodiment of the invention.

Figure 2:
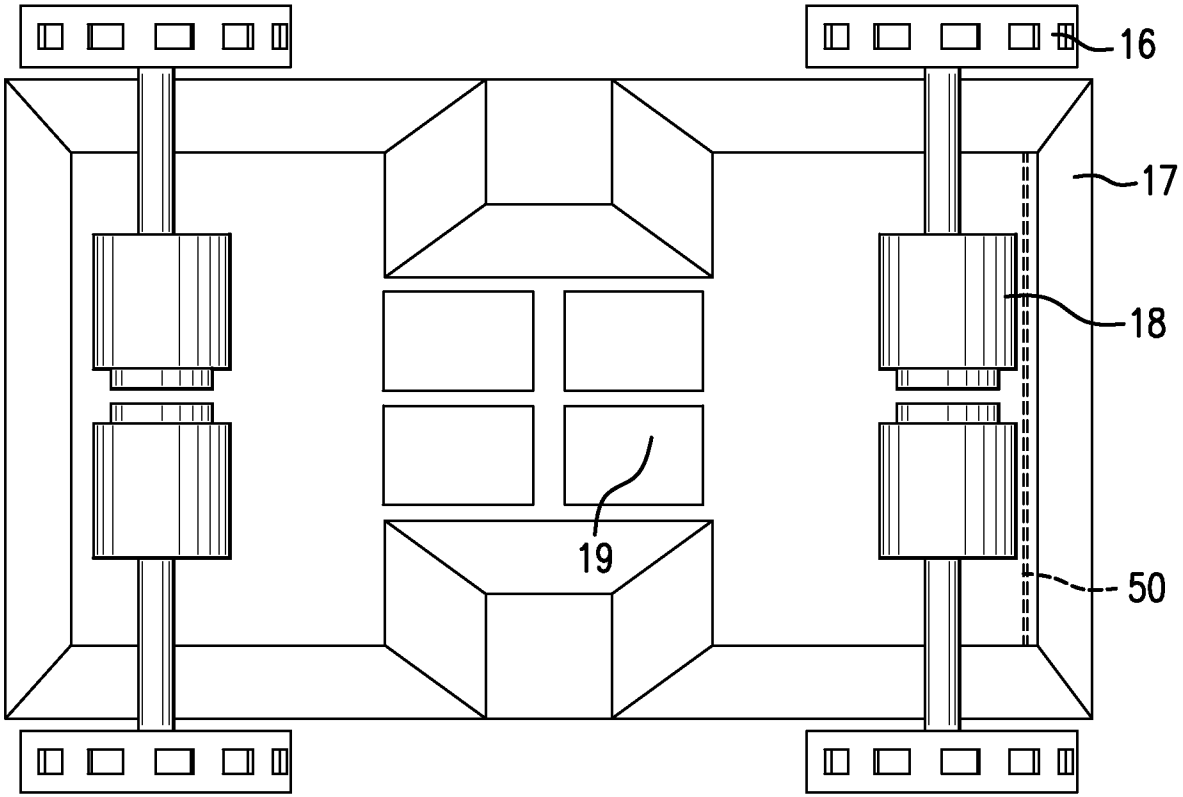
FIG. 2 is an interior schematic section showing the chassis-body-drive arrangement.

FIG. 2 is an interior schematic section showing the chassis-body-drive arrangement.

FIG. 3 is a side elevation schematic view depicting the configuration of the mine countermeasure system.

FIG. 4 is a perspective schematic view of a powder actuated warning flag.

Figure 5:
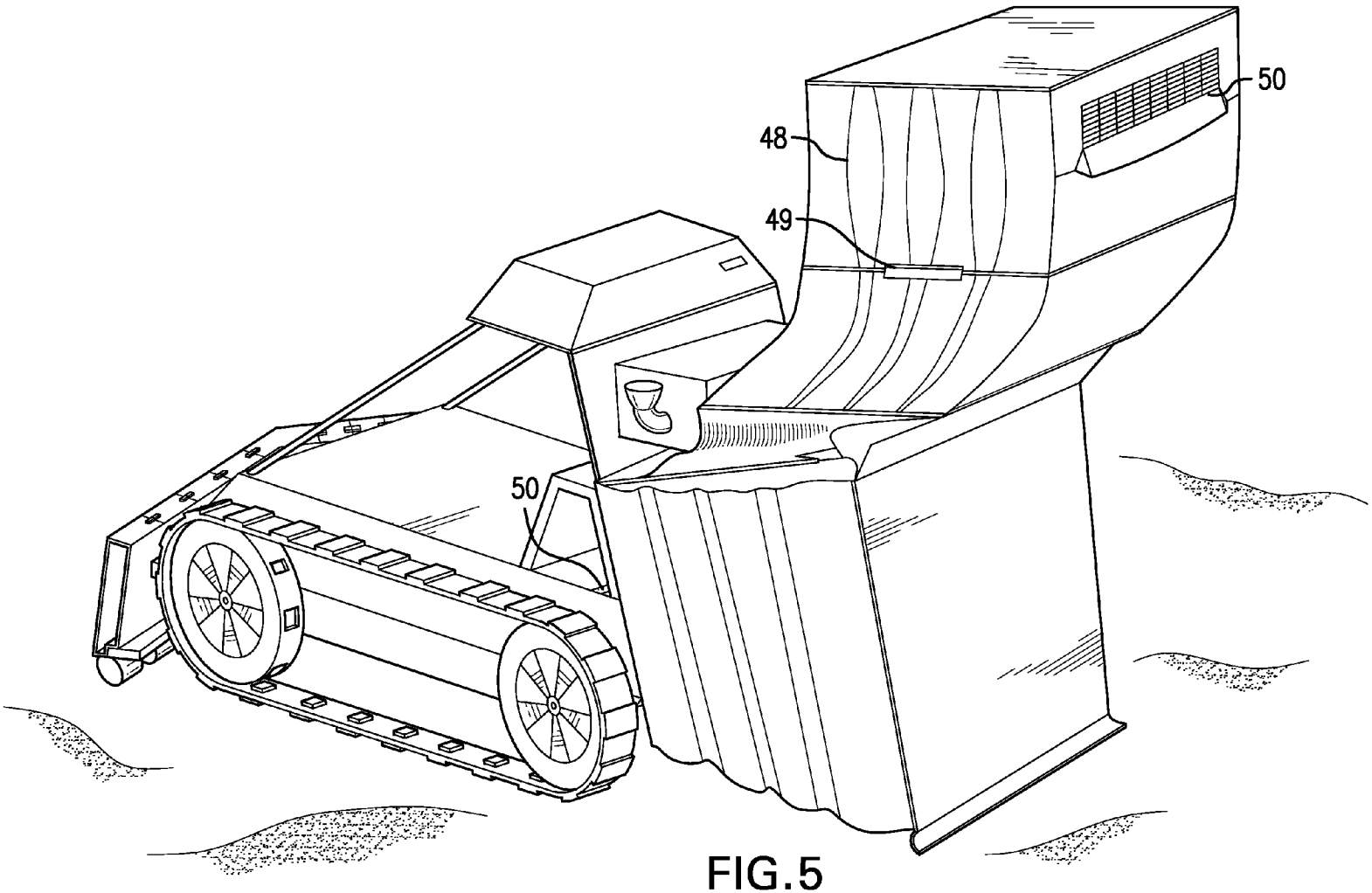
FIG. 5 is a rear perspective schematic view of the exterior of vehicle.

FIG. 5 is a rear perspective schematic view of the exterior of vehicle.

Figure 6:
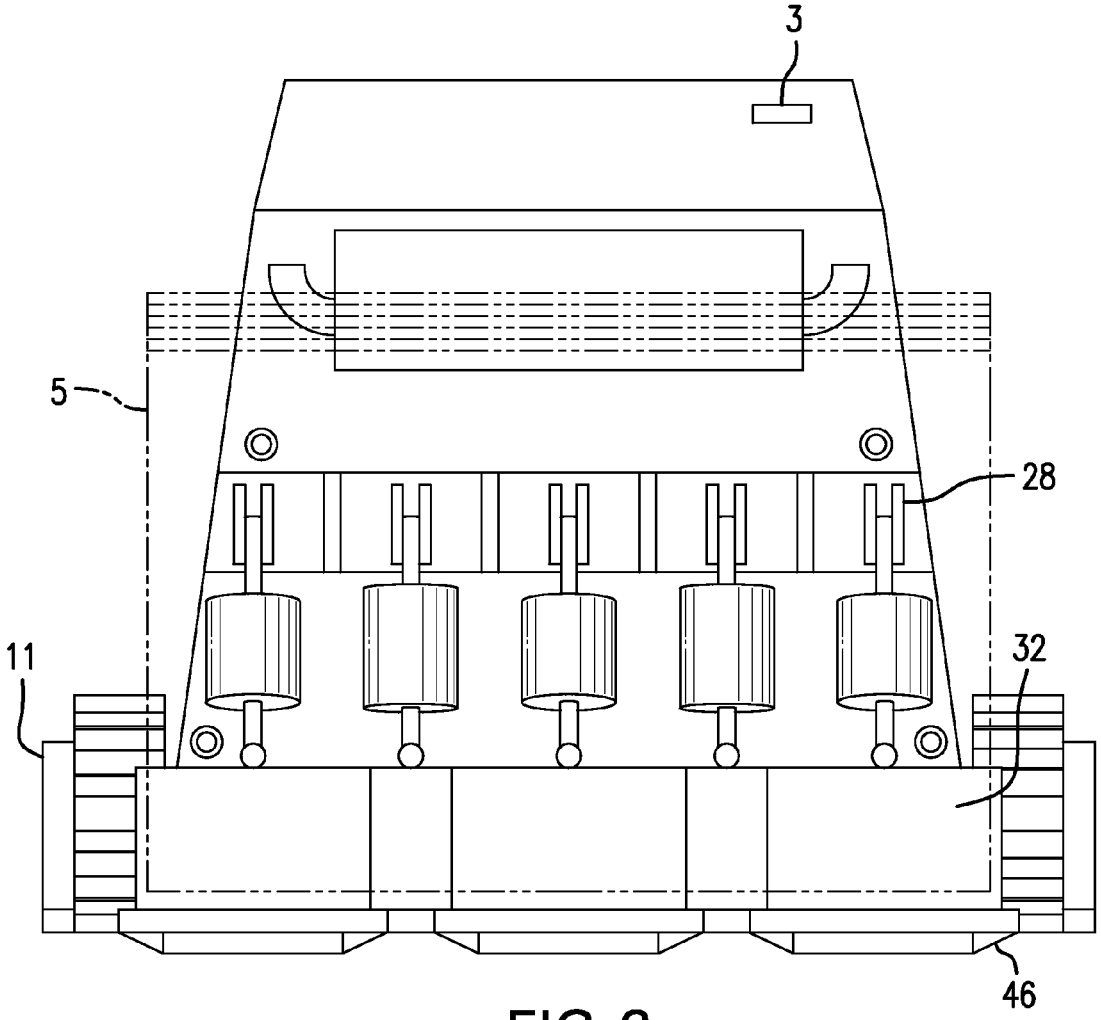
FIG. 6 is a partially exposed rear view.

FIG. 6 is a partially exposed rear view.

FIG. 7 is a plan schematic depicting the Green Energy Thermal Electric Generator/Gas Reactor Module.

Figure 8:
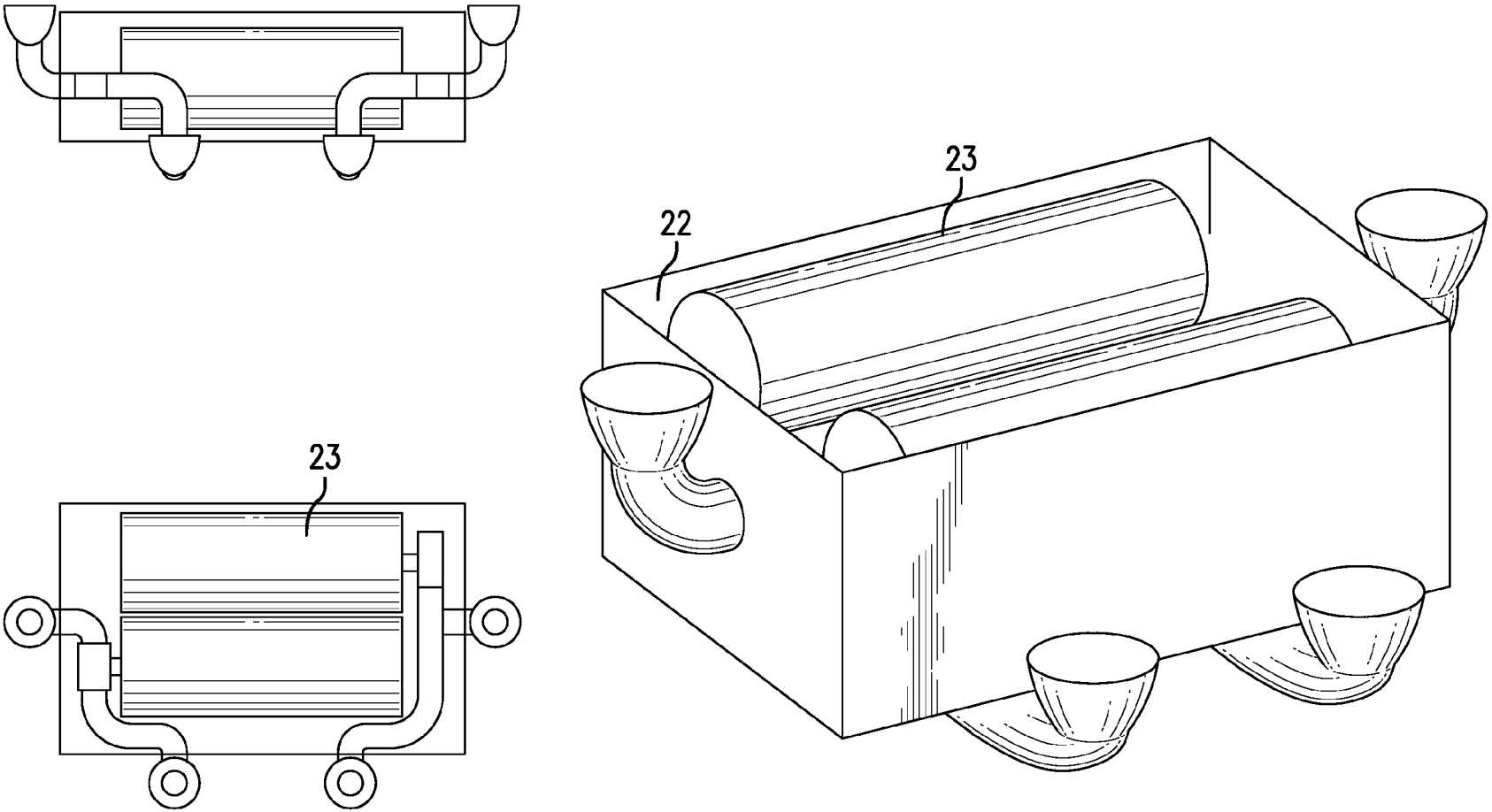
FIG. 8 depicts one alternative for a gas ejection system.

FIG. 8 depicts one alternative for a gas ejection system.

Figure 9:
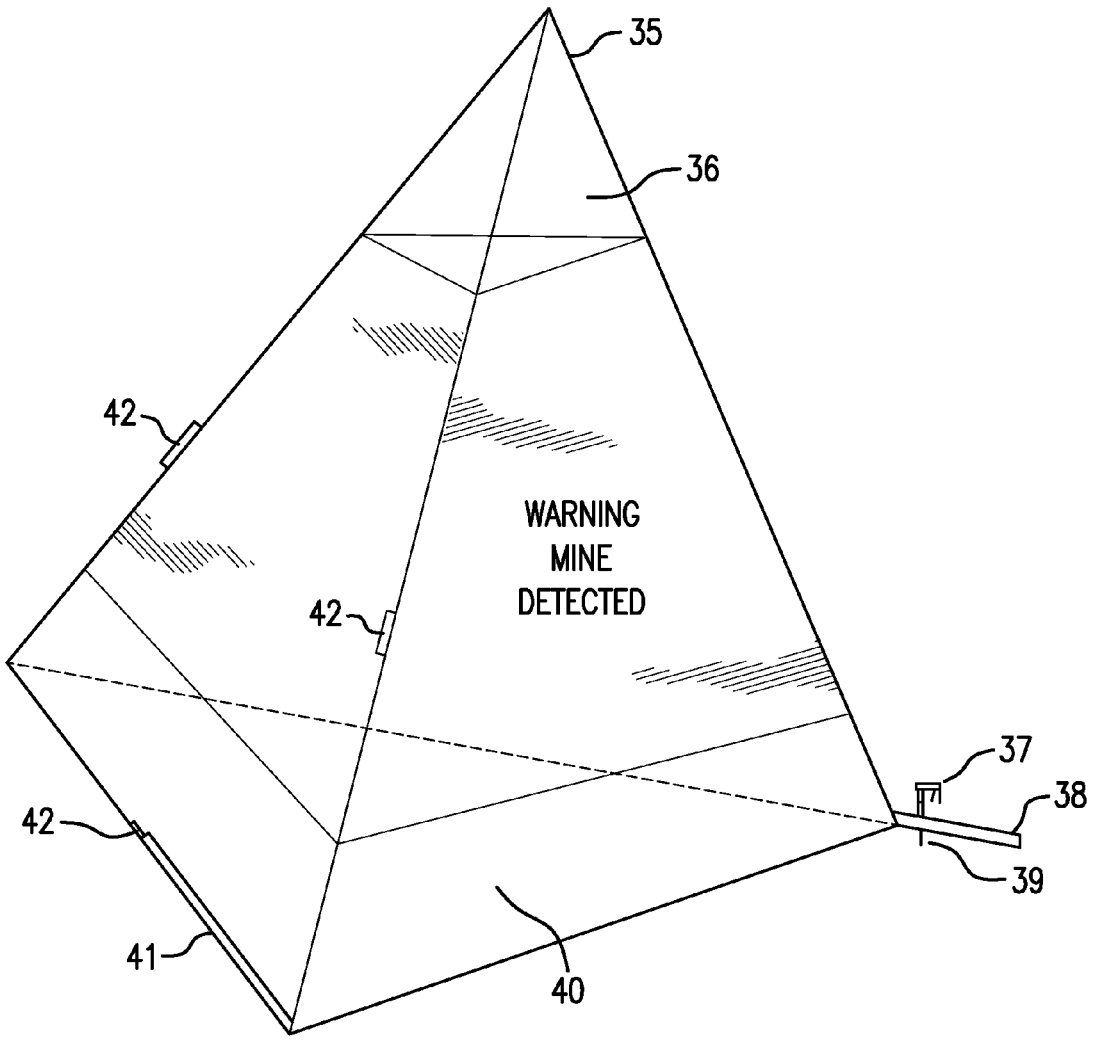
FIG. 9 is a perspective schematic view of a powder actuated warning flag.

FIG. 9 is a perspective schematic view of a powder actuated warning flag.

Figure 10:
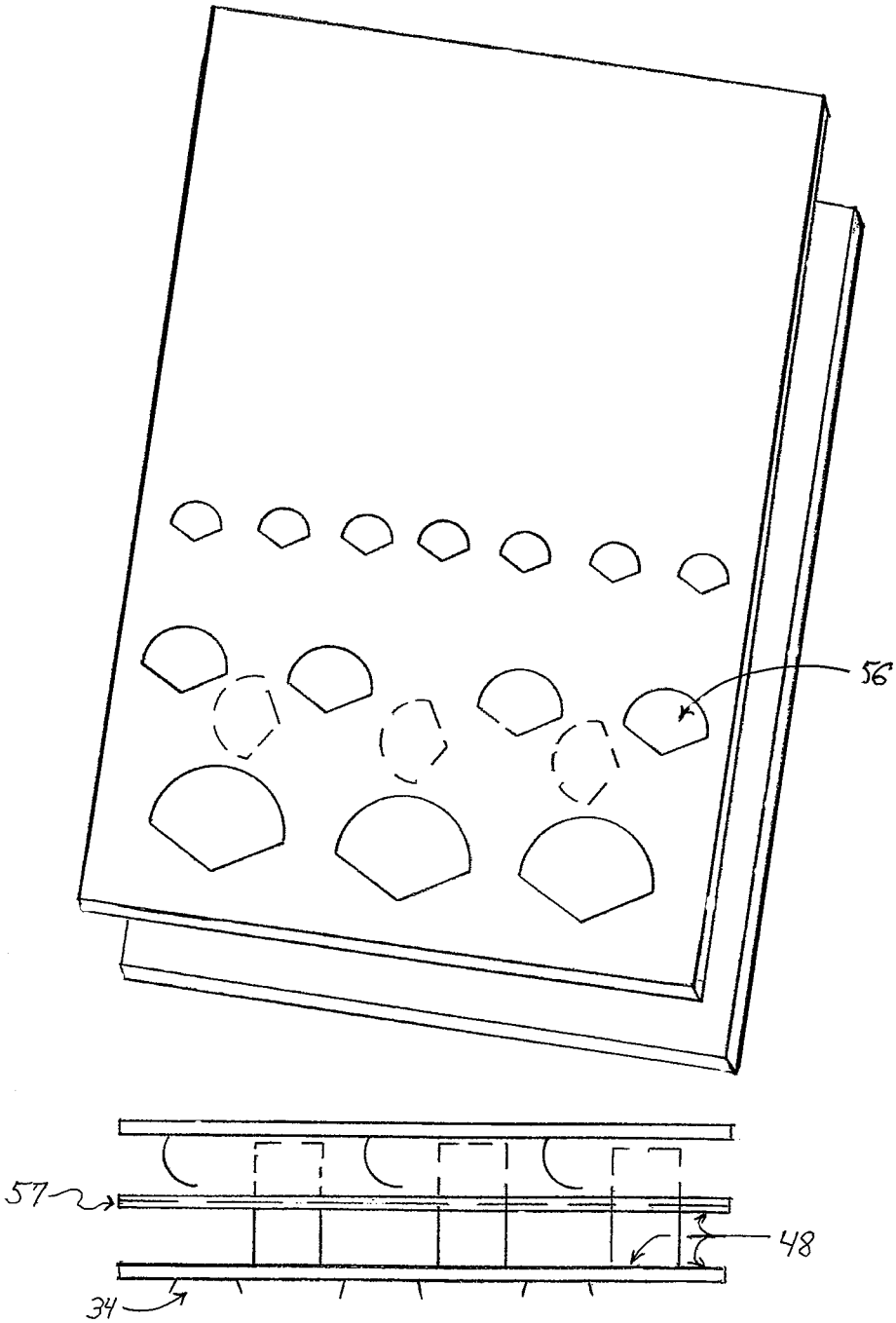
FIG. 10 depicts an isometric view of the electromagnetic sandwich foil with charge system.

FIG. 10 depicts an isometric view of the electromagnetic sandwich foil with charge system.

Figure 11:
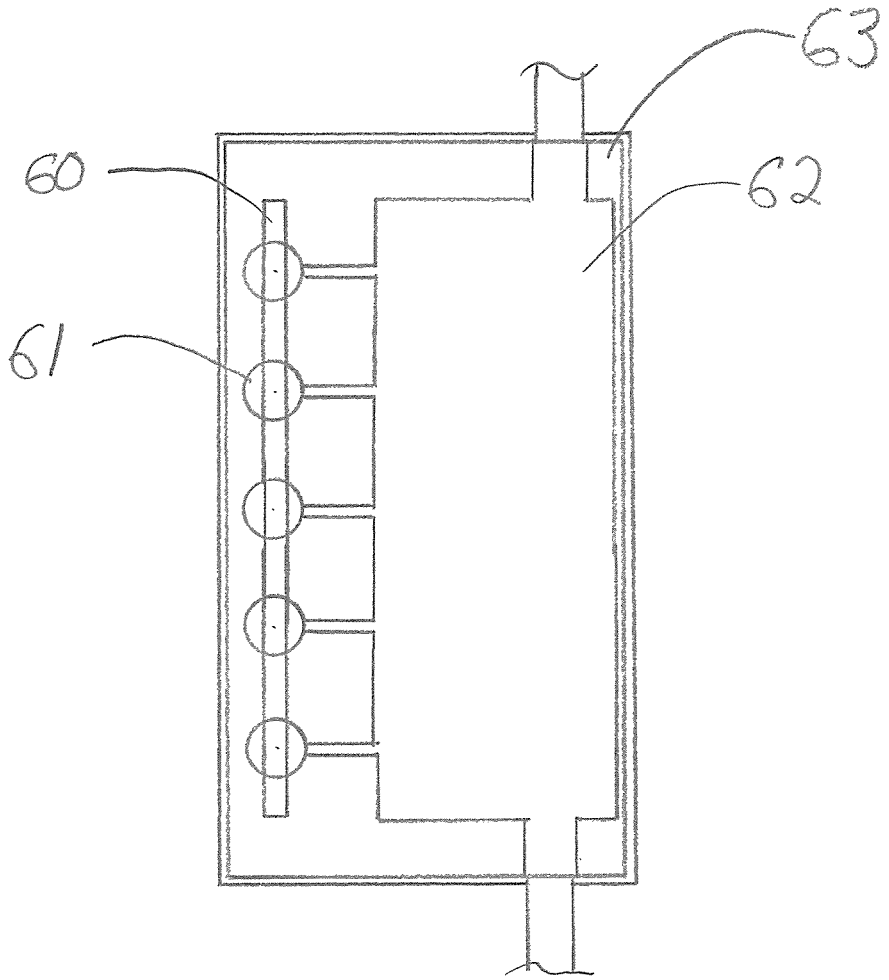
FIG. 11 depicts the integrated shutter, cartridge cell and TEC assembly.
Figure 1:
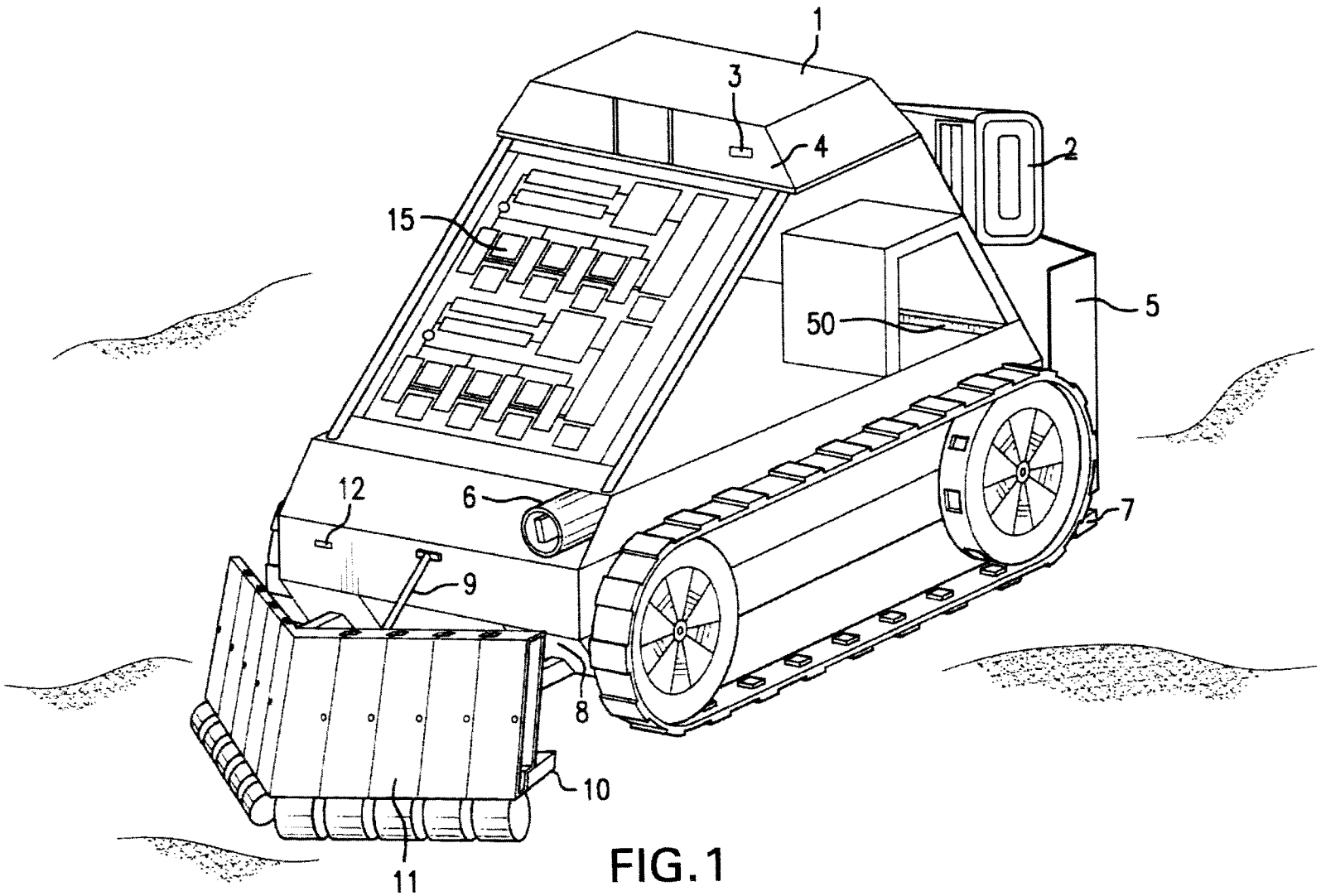
Figure 2:
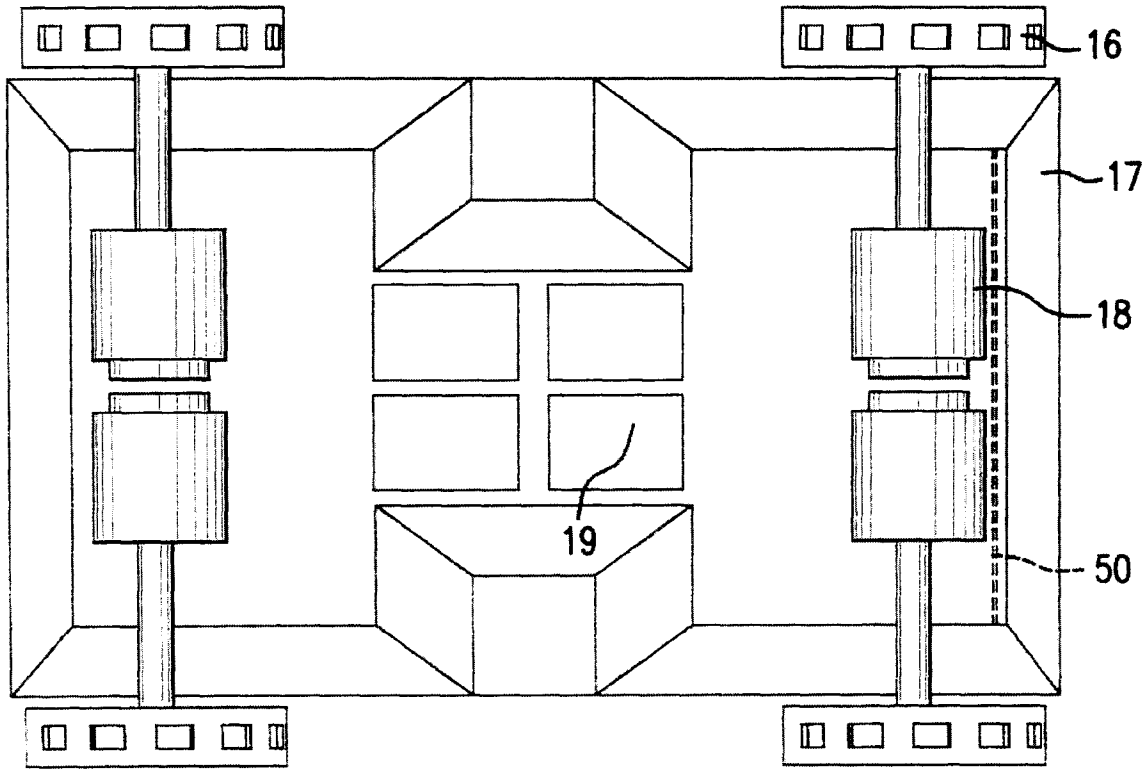
Figure 3:
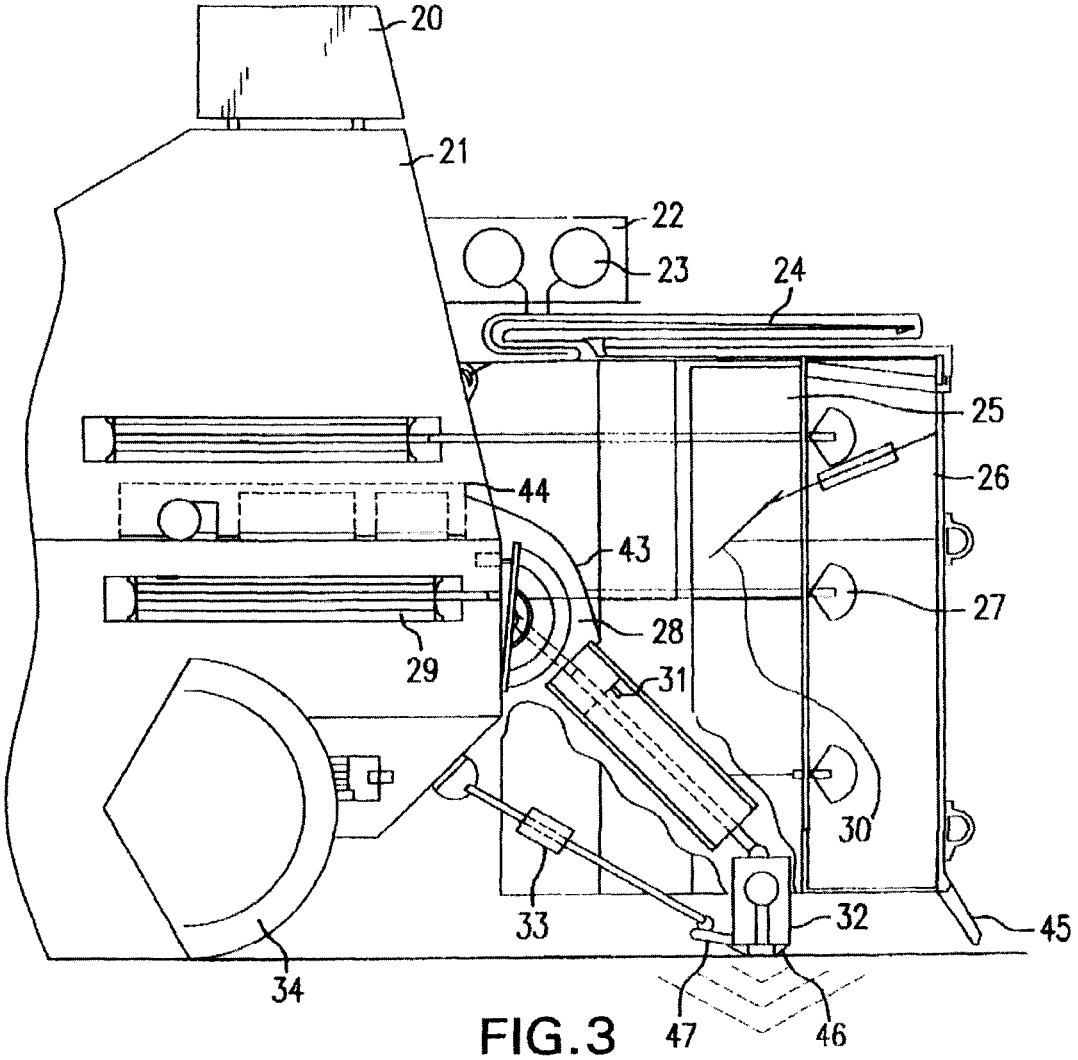
Figure 4:
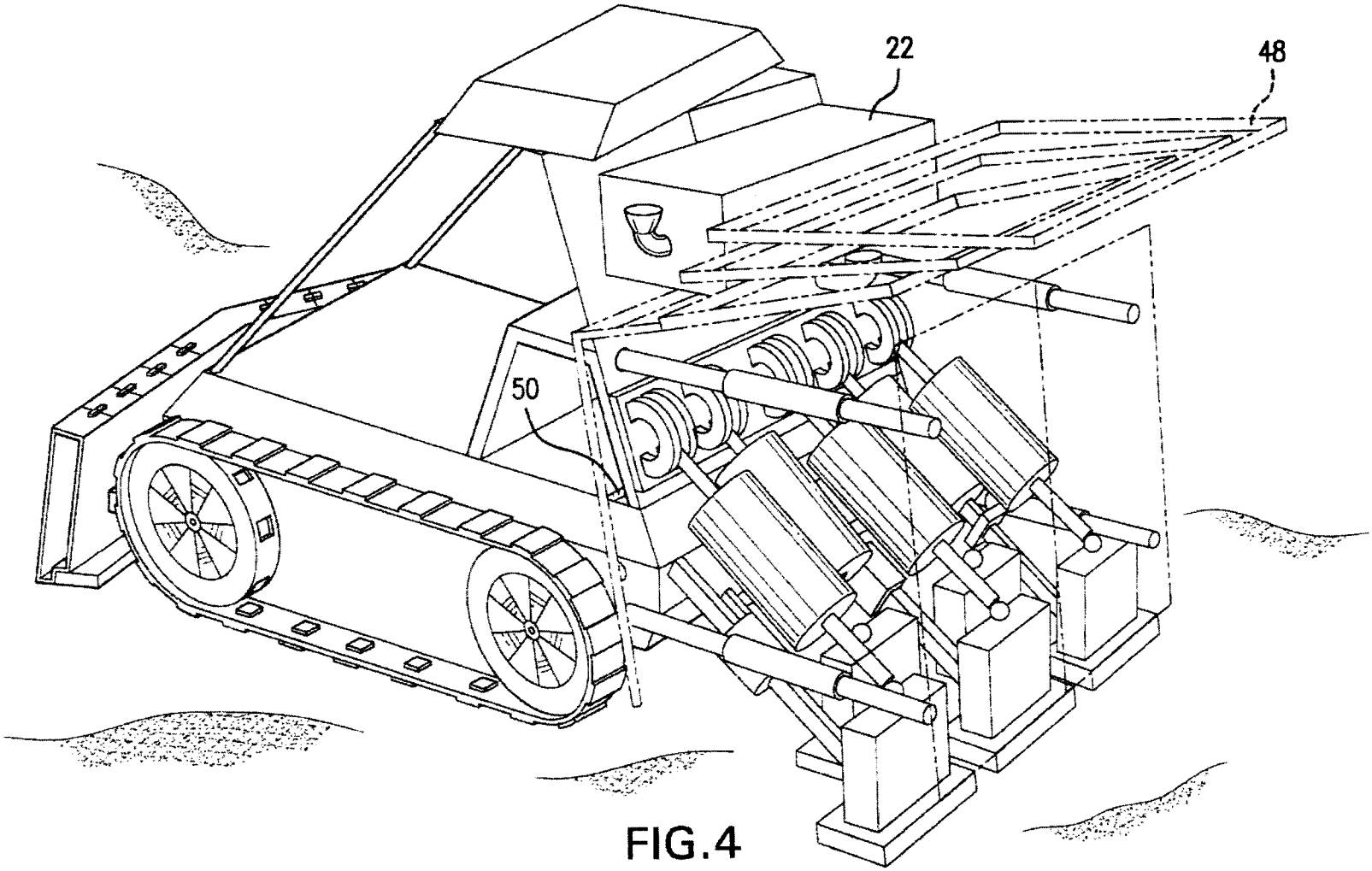
Figure 5:
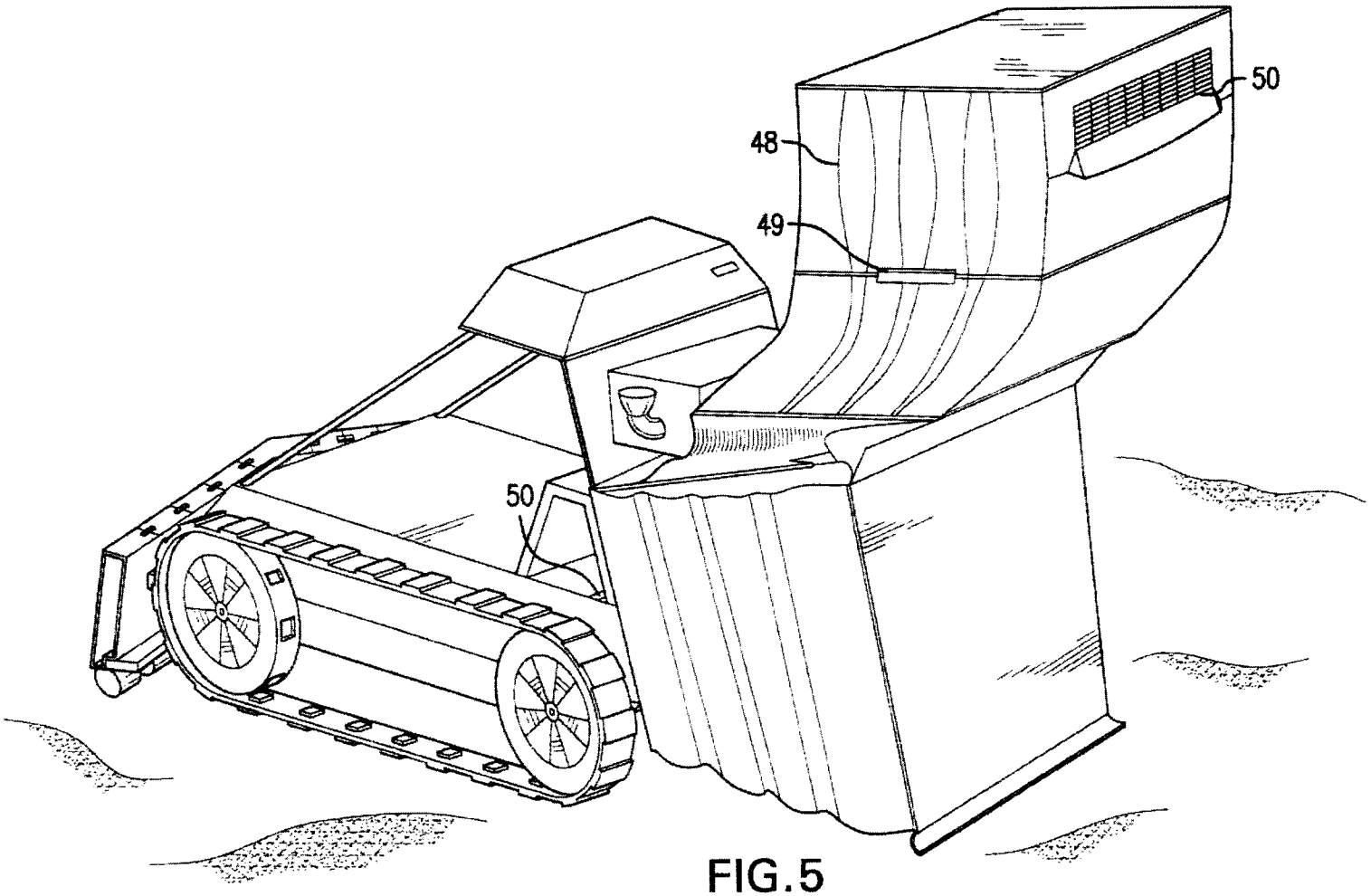
Figure 6:
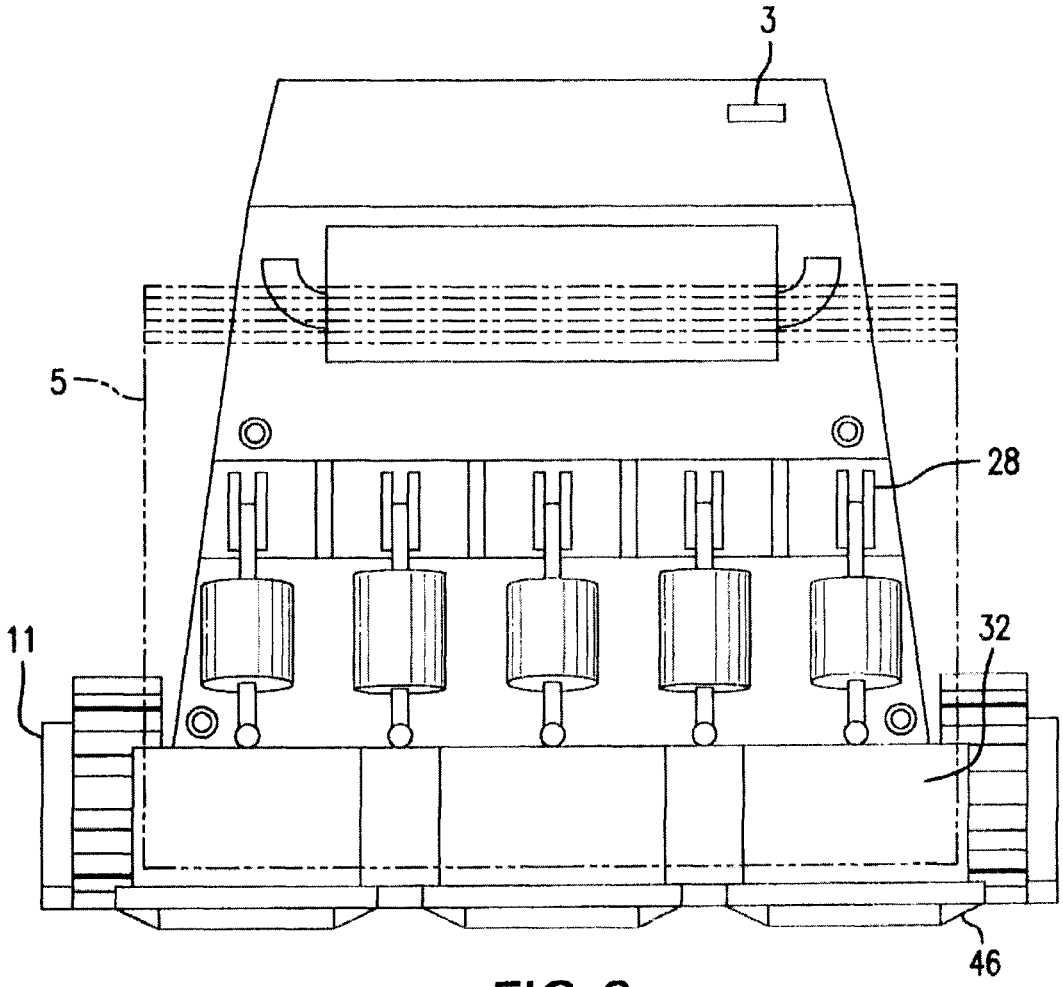
Figure 7:
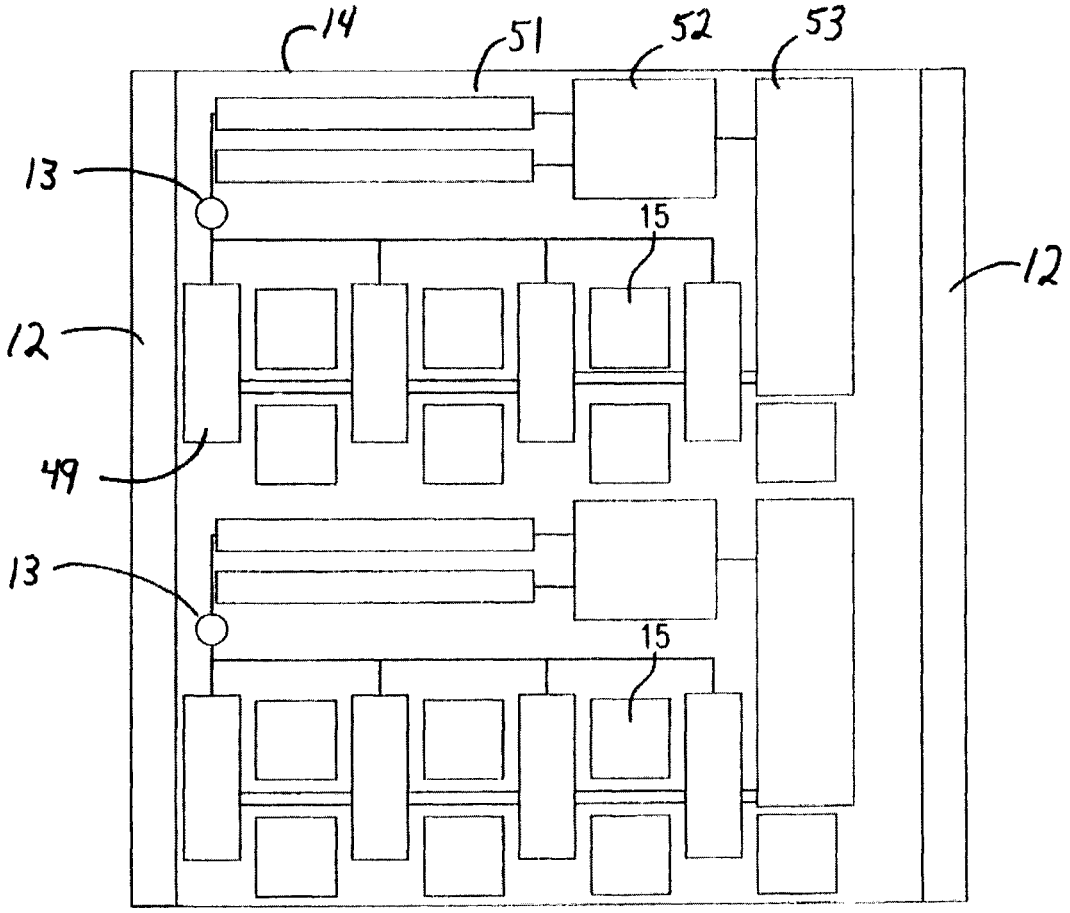
Figure 8:
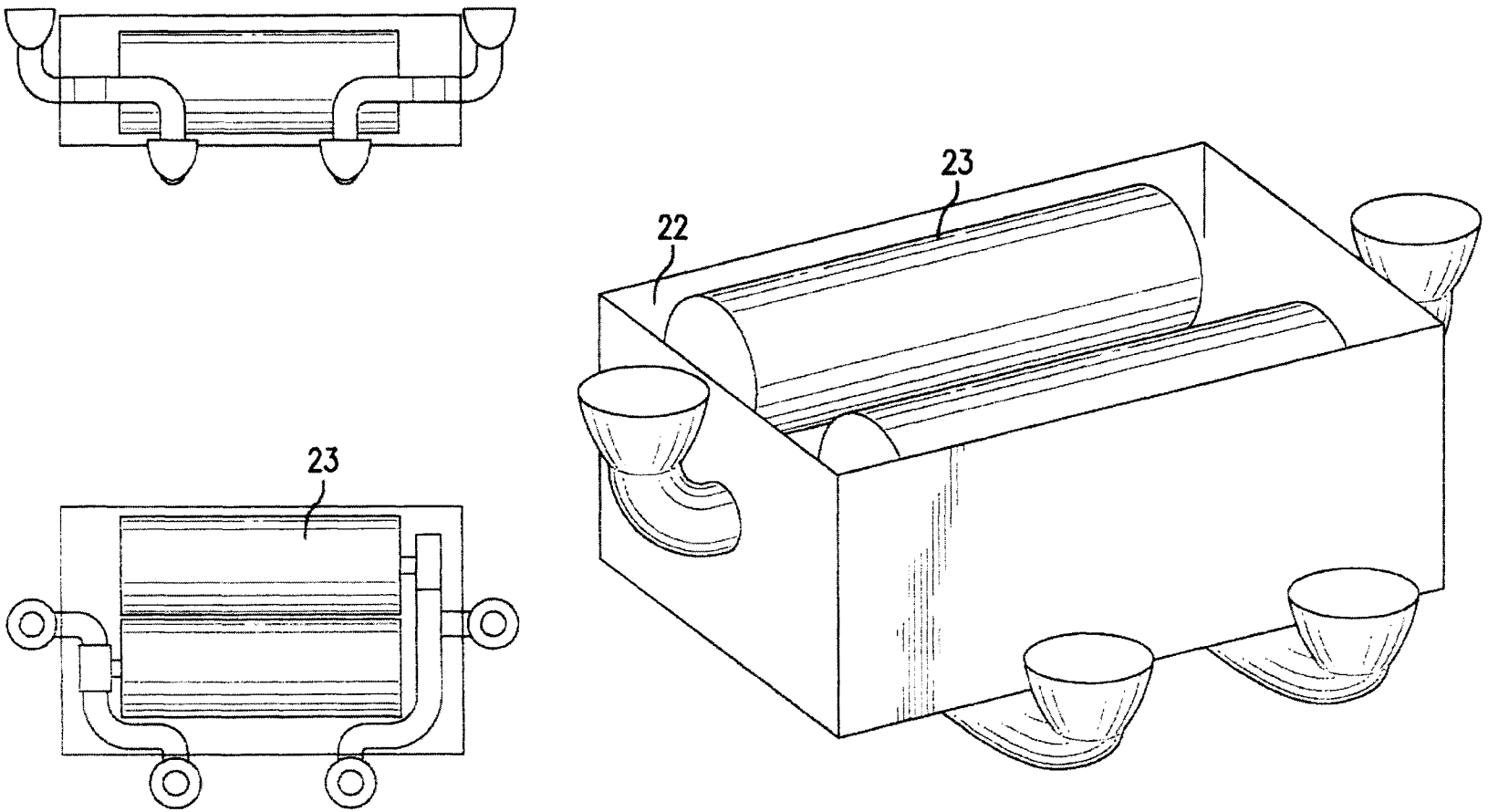
Figure 9:
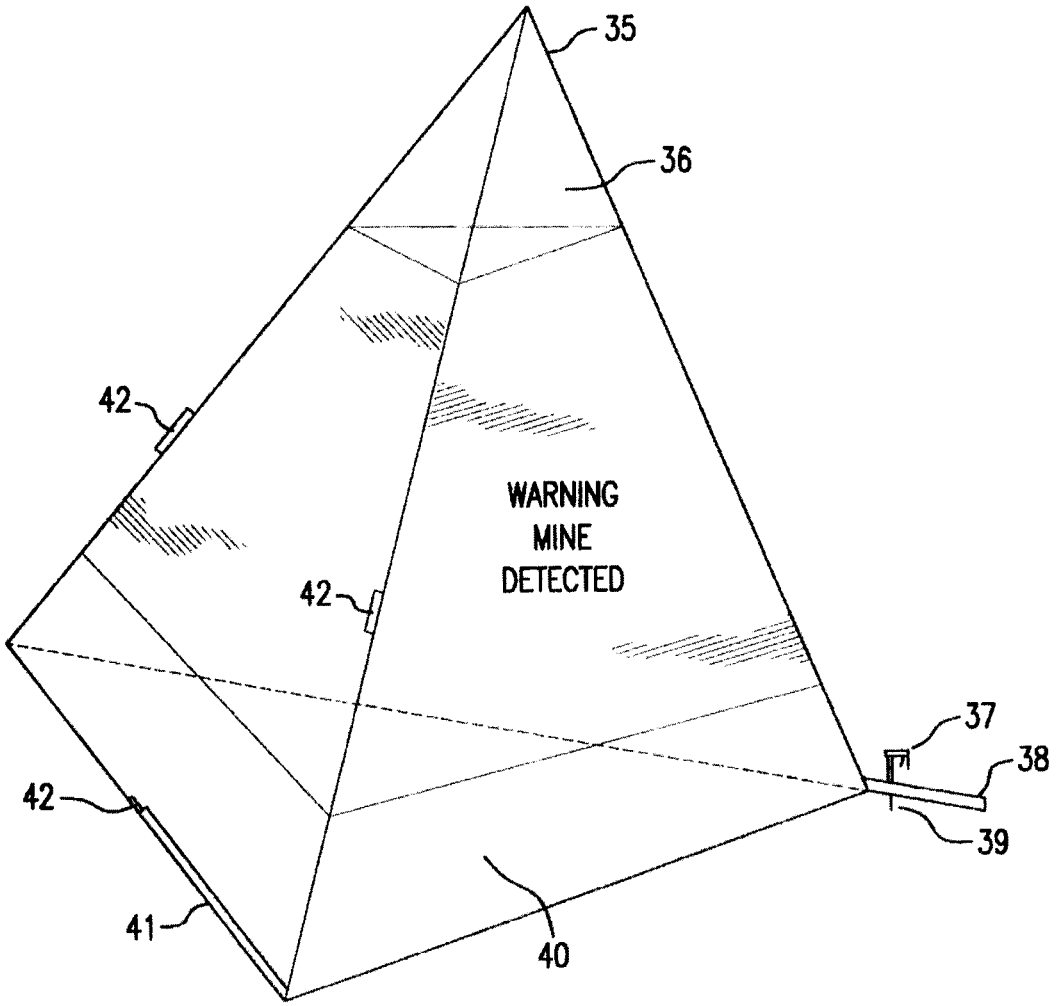
Figure 10:
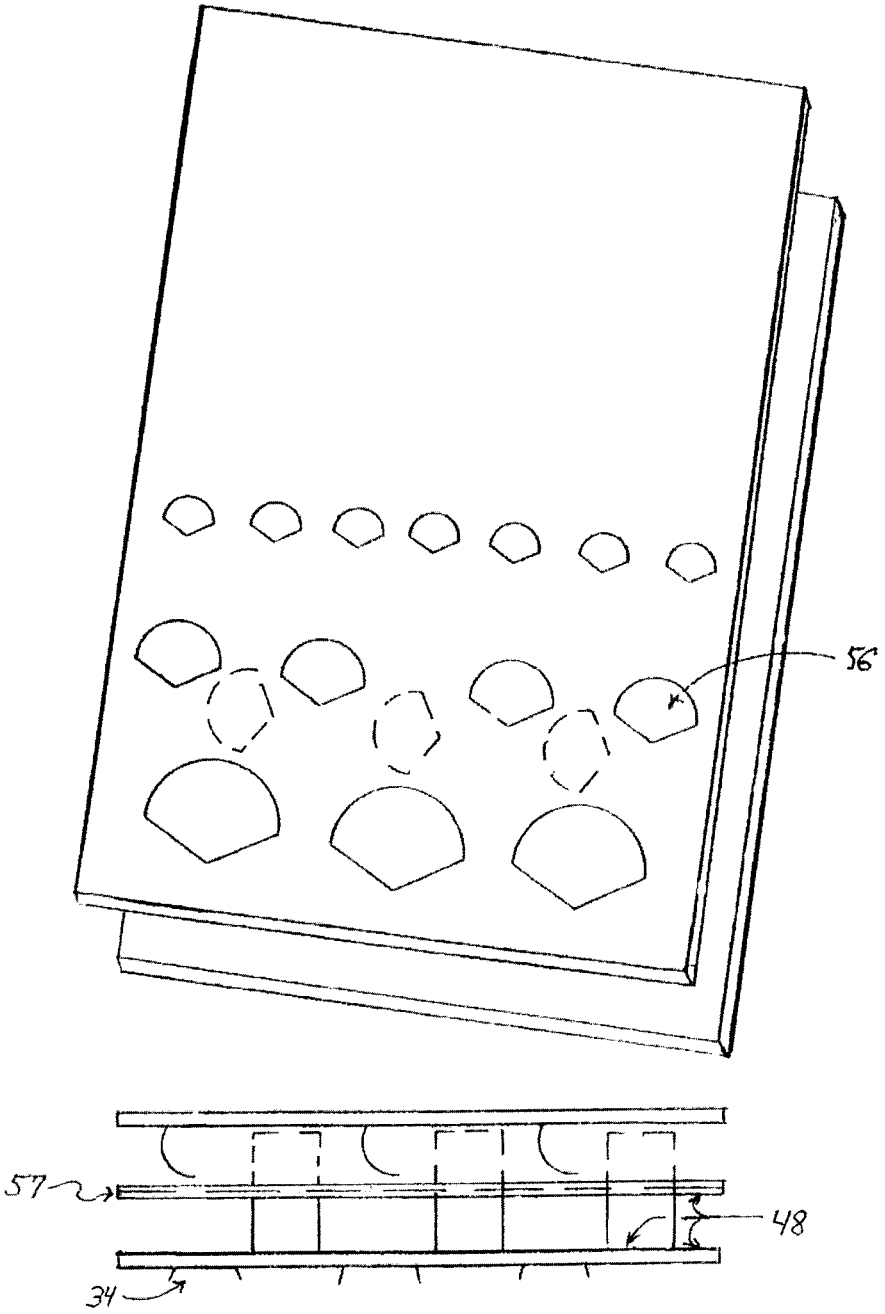
Figure 11:
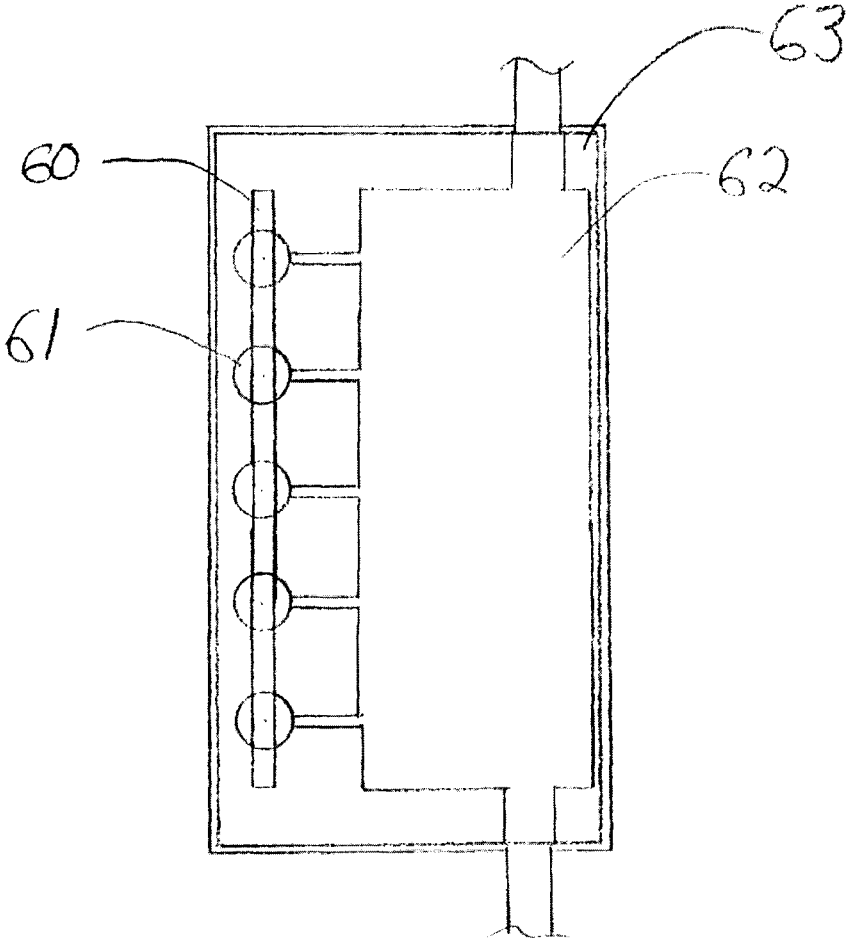

FIG. 11 depicts the integrated shutter, cartridge cell and TEC assembly.

| Drawings - Reference Numerals | |
|---|---|
| 1 | turret |
| 2 | canopy |
| 3 | camera |
| 4 | slide black Box |
| 5 | rear Blast plate |
| 6 | flag deployment system |
| 7 | vertical reciprocating system |
| 8 | concealed robotic arm system |
| 9 | self leveling system |
| 10 | detector |
| 11 | deflector |
| 12 | thermal electric chips |
| 13 | turbines |
| 14 | energy conversion housing |
| 15 | photo voltaic cells |
| 16 | wheels |
| 17 | chassis-body |
| 18 | DC motors |
| 19 | batteries |
| 20 | turret |
| 21 | chassis-body |
| 22 | gas tank system |
| 23 | gas nozzles |
| 24 | gyro |
| 25 | curtain billows |
| 26 | rear blast plate |
| 27 | mounting rod |
| 28 | hinged sliding spline control bracket |
| 29 | strut-cartridge |
| 30 | foil lever |
| 31 | control volume solenoid valve |
| 32 | vertical reciprocating power head |
| 33 | axial actuator |
| 34 | charge assembly |
| 35 | remote deployable flag |
| 36 | open edge |
| 37 | trigger |
| 38 | anchor base |
| 39 | powder actuated anchor |
| 40 | recoil rod |
| 41 | optional additional anchor base |
| 42 | spring to rod connections |
| 43 | pressure activation lines |
| 44 | pressure system |
| 45 | apron |
| 46 | probe boot |
| 47 | probe shoe mine detector |
| 48 | electromagnetic coils |
| 49 | gas cells |
| 50 | chute |
| 51 | capillary channels |
| 52 | evaporator |
| 53 | condenser |
| 56 | opening |
| 57 | plate surface |
| 60 | shutters |
| 61 | magnification lens |
| 62 | heating chamber |
| 63 | gas reactor |

DETAILED DESCRIPTION OF EMBODIMENTS

As shown in FIG. 1, is a new use non-conventional sized battery powered, solar charged, unmanned vehicle that is sized so as to create a clearing path for people travelling on foot. The first apparatus 11 is the self-leveling debris deflector. The primary chassis contains a solar panel 14 with a high resistant and magnification surface 13. From FIG. 2, a vertical interior section view looking down with the four drive wheels 16 can be found. Inside the chassis 17 are normal DC drive motors 18, current controller means and the battery set 19. The top of the chassis provides space for an optional bio-fuel power-plant that is not necessary but would provide added daily service hours that may be of advantage. In front of the chassis is an optical camera 12 for close in monitoring of operation of robotic arm that is stored in a recessed chamber 8 and for warning flag positioning. Above the chassis is a structural frame, which acts to support the green energy module 14. This panel is secured to the frame with isolation attachments should an event causing toppling occur. The panel surface is damage resistant.

Many types of Green energy sources are possible for energy conversion for power and recharging in the industry's current technology. The differentiating detail noted in the following method is the aspect of energy being created by both solar and gas means for recharging purposes. The system is not limited to energy generation by heat reclamation from internal processes. The following embodiments of green energy use are described in sufficient detail to enable those skilled in the art to practice the invention. One or more multi-stage systems may be used in parallel are contained in a protective housing that is field replaceable as a unit for maintenance or from damage with quick connect frame attachments and energy cables.

The proposed system, FIG. 7, has the following process to convert both thermal and light energy using sunlight and gas. Contained in a protective container are several elements which transform energy. The simplest form is the photovoltaic cells 15 which may have a magnification prism or lens for intensification. These are distributed in the container around all other elements which are of irregular geometry. They provide immediate voltage from sunlight exposure.

Another electrical generating method contained is a liquid to gas vapor system 63 wherein the vaporized fluid is channeled through a turbine generator 13. The time controlled heating of fluid to gaseous phase is accomplished by a set of shutters 60. A magnification lens 61 focuses sunlight to vaporize the working fluid. One way pressure valves control the flow of fluid in the system from the fluid chamber to the heating chamber 62 through the turbine to the vapor chamber for reliquification.

The working fluid may be methanol, ammonia or acetone although other fluids may be used. The vapor is reliquified in the heat transfer device for use in the system again. The heat dissipation device may include elements such as fins or rods that provide large surface for providing spreading and dissipating heat including volume expansion devices. Other effective means such as capillary channels 51 may be used to improve efficiency for vapor reliquification.

An effective manner of phase change rate is to provide a permeable membrane to make an efficient mass transfer process. The process makes use of capillary transport force acting on the interface of the porous material thereby increasing the rate of vapor venting and removal of corresponding heat flux. A classical evaporator 52 and condenser 53 system may also provide for to maximize the reliquification process.

An additional method for turbine generated energy is included by the introduction of either pure gas such as propane by pressure cylinder vessels or concentrated solid pellets with known dissociation kinetics can create a reaction cell for daily use. The pellets may be of any size which maximizes the liquid gas reaction. The pellet would then combine with an adequate solution and/or catalyst to facilitate the gas expansion phase in the cell. A series of cells forming a cartridge like insert is possible for cell by cell depletion having the individual cells connected into a parallel manifold pipe. Each of the cells having a pressure sensitive orifice disk which ruptures at a predetermined pressure or temperature. Each cell being activated by automated timed sunlight shutters with magnifier lens. Upon depletion of the cells gas concentration, the sunlight shutter is directed towards the next full pellet cell. This pressurized gas then passes through the turbine for additional electric charge. In line flow restrictors control any overpressure. These pure gas methods are utilized by providing a by-pass tube allowing for venting externally away from the evaporator condenser process elements.

The total package delivers an effective optimized combined multi-process for exploiting green energy. The combined Thermoelectric Generator 12/Gas Reactor 63 charging system will allow for longer daily use of the system.

In addition to the previous discussed energy methods for conversion. The current state of the art allows for other various methods of conversion. Additional capabilities may be achieved by the use of hydrogen cell power conversion charging stations. These stations can greatly extend the network and range of coverage for the individual containment robots. Each station would allow for overnight charging which would make the daily duty rating increase. The typical station can be a standalone protected structure for the power generator and containment robot. The primary low demand and low cost continuous refueling requirements would be vessels of water, hydrogen and routine maintenance.

The supporting frame is also a shock cage, which has internally telescoping cylinders for force dampening. Above the shock cage is the turret 1 which is able to swivel horizontally 355 degrees. The turret 1 contains two optical cameras 3, one forward that creates 3D vision when synchronized with the lower chassis camera 12 and one to the rear for real time monitoring and motion detection and verification. Motion to identity security containment and control is accomplished. This significantly protects those registered in the safe zones and residing in the secured areas with personnel and civilians using IC Card verification. A simultaneous process of motion detection with verification of safe zone identification signals is read by computer hardware in the black box 4. Establishing this security process in any area of mine placement activity defends against further mines from being placed. The onboard capacity contains the logistics that would assemble information into a centralized database for use with and for field personnel to access this remote mobile vehicle. Information integration and analysis becomes real time. Verifying ID, document check, and controlling a single identification is extremely crucial as the ease of multiple identities is wide spread. Selective biometric applications involving identification cards containing radio frequency capacity technology for control movement in secured zones. Modernization programs rely on individual identification cards being required to carry. The following soft approach abilities for data gathering are presented for use in an efficient integrated fashion at low cost. Each optical camera is included in a self-contained blast resistant removable black-box 4, one on each side of the turret, which contain operational control and communications integrated circuits and hardware. The turret is also supported from the rear by the back wall, hinged at the top, for additional dampening benefit.

The self-leveling and retractable deflector 11 is illustrated in FIG. 1. Each panel section is slightly angled from the vertical and from the path centerline forward, so as to give a rolling momentum impact force out and away from the path of vehicle. Each panel segment is connected by a simple hinge-pin mounted at mid-panel height. The panels are overlapped so as to create uniform coverage while sloping up or down on the path's surface. From the existing ground surface, tines are placed which act to catch and clear individual stones larger than ¼ inch round in size. The deflector panel assembly is fitted with guide rollers, which produce very little downward force when not mechanically controlled with a height sensor controlled system. The assembly is supported by two side arms that act to maintain a controlled forward projected distance from the chassis and allow for upward rotation retractability when not in use. The total assembly creates a self-leveling effect. Immediately behind deflector panel assembly is mounting table and detection device 9. Within any of the mechanism sections, a canopy may be contained and remotely deployed by any method known in the art. The top of the deflector assembly may have a secondary canopy system mounted over.

The primary countermeasure system is illustrated in FIG. 1 and is a new assembly or unique apparatus for simultaneous triggering and containment of mines. The three features are shown at the rear of the vehicle. The vehicle may work in reverse direction where hazards are extremely high to maximize containment advantages. At the rear of the vehicle a vertical reciprocating system is shown 7, followed by a containment plate 5 and covered by a canopy deployment system 2.

From FIG. 3, the rear of the vehicle can be seen. At the ground surface, each reciprocating foot 32 assembly has a determined width, which applies the appropriate pressure based upon the range of in-situ soil shear strength present where mine detection is to take place. The advantageous feature being created is that the reciprocating system assembly self-propels itself in two distinct ways. First, the individual line of action is inclined a few degrees from vertical, as a foot does. Secondly, the lower control arm has an axial actuator, which has a controlled advance throughout the timed cycle of operation. Each foot has a power head that provides a means of rotation and a controlled variable positive soil displacement, which acts to alter soil at or below surface and accomplish the mine trigger objective by simulating foot pressure and motion. Accomplishing triggering, ignition or downward force may be by any means known in the art which may include, but not limited to, plasma, rollers and electric inductance or electromagnetic means.

The modular, preloaded feet with reciprocating probes are signaled to cycle in a timed fashion for maximizing the net downward force. Downward force for each assembly is provided by a preloaded pressurized strut 30, supported by a vertical spline control bracket 28, which limits horizontal range. The configuration of this apparatus is designed to remain in a horizontal orientation for existing ground undulations of plus or minus three inches and maintain continual ground contact.

From FIG. 3, an improved embodiment may be utilized in the form of a dissipating strut and probe assembly for the clearing of mines from pathways. To ultimately reduce the drag for motion and improve vehicle stability, a plurality of elements are utilized to work together or can be used separately.

In this embodiment for said dissipating struts 30, an improved strut performance can be realized. Each strut utilizes a control volume for manipulating the amount of gas/fluid to be displaced during extension and compression. While the reciprocating function of the probes are under way, the control of downward force is controlled in a cycled manner from a lower pressure value to a timed and synchronized higher value. Both values are able to be controlled by the predetermined size of vessel and the internal rate of displacement from the rod extending or compressing when entering and exiting the strut cylinder. The cycling operation is activated by the use of an internal solenoid valve 31 mounted into the control volume wall which when activated opens and closes the additional internal control volume within the strut chamber. The cycling timing of the solenoid valves is accomplished by the computer or a separate controller which sequences the strut high pressure level with the probe extension.

In another embodiment, a pressure system 44 with accumulator and manifold has pressure activation lines 43 connecting from the dissipating struts to a timed pressure manifold and relay system which combine electrical signals and line energy to open and close manifold valve ports, extend each probe assemblies, being branched and controlled separately to sufficiently cycle the probe extension with high strut pressure in a sequential manner. A controller sends signals to the relay of the manifold and to activate the probes together in a cycled and sequential manner of operation. Activation lines may be energized in an air, electrical and/or hydraulic manner. A combination of the two methods may be utilized for maintaining redundancy and improving reliability.

The strut controls the amount of downward force on the probe head. The overall assembly may be raised or lowered by rotation through a hinge located on the spline bracket and may be by hydraulic means. The spline plate brackets 29 may be used independently for each strut and probe assembly or mounted on a single plate. The movable plates and their positions have a maximum load rating in the extended down operation position that freely release upon detonations by means of a breakaway link, load failure device or other load limiting mechanism that may incorporate an axial piston or other suitably fashioned device to relieve over-pressure. The primary combined feature is a piston lowering the hinged plate and upon a specified overload pressure, the plate rotates closed and simultaneously slides up for a short distance. This combined mechanism and load path creates a deadening effect for the short duration of the pressure wave.

As an alternative, another possible arrangement for the probe head connection and to maintain vertical orientation of the probe action is through the use of a modified connection, a spherically seated control knuckle providing a limited range of rotation. This may allow for more extended use in the field should damage occur. In this embodiment, the base of the strut rod is connected in a vertical plane hinged manner, with a slight degree of out-of-plane deflection possible, to follow the existing ground profile. One embodiment of the connection is to use a control knuckle which has a ball or spherical shape connecting to a similar shaped receiving yoke type socket mounted vertically into the top or side of the probe head surface. The top of either type ball shape used is further guided and controlled in a single vertical plane direction with limited angular range of motion in both rotational directions, accomplished by having a rectangular opening in the top of the socket face and attached to the probe head. The load exerted through such an assembly causes forces to be transmitted normal to the plane, perpendicular to that mounted plane which achieves a desired inherent self-balancing downward force. Said knuckle design may allow for single connection to probe head should damage occur to other links. This forged spindle ball joint has a controlled seat.

The strut assembly may have a critical break-joint design feature to have a planned strut loss to enhance vehicle stability. The break joint may consist of a reduced section of the strut rod or an equivalent means for high load failure. A plurality of mounted dissipating strut assemblies are possible. Each strut assembly may have a pressure limit valve or blow-off for relief of pressure in or on the strut housing for relief activation during the mine event.

To further absorb energy and minimize energy effects, the configuration of certain elements may be introduced and the strut probe head assembly. A unique arrangement of benefit may be utilized. The probe head or other mechanisms may be configured so as to have a slightly cupped face facing towards the imminent blast point. The effect of concentrating a calculated percentage of force through the strut would be directed into the recoil bore assembly. Additionally, a portion of the pressure wave will be redirected. The probe head face plate may have a V shape or other shape to direct forces. To increase the pressure rise time, a layer of viscous material may be added onto the face plate of the triggering mechanism.

The strut assembly having a central rod becomes driven through the strut housing. The strut rod and housing assembly may be conventionally axial in action or be curvilinear and may have a pivot connection. As a method to slow the instantaneous effect of the blast, the strut rod may be made longer to achieve a better time of dampening forces. Absorption of energy is treated as recoil except the gas or fluid orifice pressures would be containing the rod force at the end of its travel acting as a shock isolator. The first rod distance traveled acting as a common shock absorber and after a predetermined overpressure an internal valve would open and the full range of rod travel into a secondary gas or fluid pressure chamber. Any series of orifices, secondary cylinder walls for relief volume may be used to increase the duration of recoil impulse and absorb energy and momentum.

The assembly may have a mounted or body formed muzzle for replaceable reaction charges. The charge may be initiated by a direct connection or signal from the probe of the head assembly to the charge in the breech upon triggering a mine. The reaction of these charges may be of various sizes and will be directed so as to counteract the upward force from the mine onto the machine. Establishing the exact position and direction for this feature will be accomplished by those skilled in the art.

The probe head contains the means for providing a reciprocating probe element. Additional mine detectors will enhance the triggering to dissipation process with an advance signal to start. This may be created by positioning the mine detector sensor on or near to the probe head. In operation, as the machine is in motion, a mine detected or located near to the probe head mine detector sensor 47 sends a feedback loop signal for gas ejection to start a few moments before the probe detonates the mine.

Any type mine detector known to exist and in the art may be attached and located in any position on the vehicle which would assist in the determination of the specific location of below or above ground mines. Mine detectors are commonly located as close to the ground as practicable. Guide roller surfaces may be included in the induction field circuit. Mine detectors may be added at the base of the deflector segments in a variety of connection means such as attachment to the individual deflector segments and probe head shoes through the use of small connection tables, brackets and shelves as well as a more ruggedized, potentially molded integral assembly, whereby the individual parts, such as but not limited to the deflector plate segments, sensors or probe head shoes form an integral, composite or a detachable-attachable assembly. The individual mine detector sensors can be hinged with springs to allow further improved ground clearances, pitch and angle of incidence and be attached by any practicable means known in the art including as a slide or snap on component.

The combined elements of probe head, probe head shoe, probe and prestage detector or parts thereof may be covered for ease of sliding motion over the ground as well as protection, by a flexible carbon fiber or blast resistant material acting as a boot 46 or jacket element for additional guarding against sand and foreign elements. The material of the boot shall be flexible to allow for the repeated probe extension cycles.

The attached mine detector mounted on the front of the vehicle locates mines. As these mines are located, a signal is sent through the feedback loop and are recorded for relative location which also may include positioning by satellite in the on-board computer located in the blackbox. The location of the vehicle is converted into data by two methods. The first is by common GPS positioning. The second is by surveyed range locators that are read by sensors on the vehicle for grid locating and stored on the computer. Other means for determining and storing distance travelled and grid location, along with user remote control exist to those skilled in the art. The blackbox protects these remote controlled, automatic and guidance control features for operation. The machine having possession of this information, along with its inherent motion tracking, calculates by means of computer when the mine shall approach the rear probe assembly with mine detector. As the machine is working its' way forward or backwards and nears the located mine, the gas ejection system is activated at a predetermined time or manually before detonation. Detonation may be accomplished by any of the known methods available known to those skilled in the art.

When the mine detector encounters a mine, an electrical signal is sent to the computer for creating a grid location using known range locators. Satellite positioning data for longitude, latitude and elevation is recorded in the computer. The gas ejection system 23 is started for the release of gas. The gas may be stored in vessels under high pressure in a protective enclosure mounted to the vehicle. The mine detector sensor signals the computer via the feedback loop and activates the solenoid valves or other means of automated valve opening actuation being electronically controlled by the detector sensors or the computer located in the blackbox. The overall operation of the machine is synchronized by the onboard computer using integrated circuits which may be remotely operated. Any means of directing gas common to the art may be used, openings, ports or nozzles to control and direct the flow of gas upward, such as a plurality of ports, outlets, tubes or nozzles which effectively direct the gas jet in the directions desired. Upward directed gas shall deploy canopy and have detonation balancing force and horizontal force to either assist to propel in the forward or rearward direction. Control of gas ejection in any direction is controlled by the computer or remotely for thrust and exhaust velocity. As an example of control of gas, a series of electronically controlled automated valves controlling the gas in each direction can synchronize the control of gas in the desired directions. Other means of gas ejection exist in the art which create sufficient gas ejection and downward force to assist in the counterbalancing of the machine or vehicle before, during and after detonations for improving vehicle stability.

The combined elements of probe head, probe head shoe, probe and prestage detector or parts thereof may be covered for ease of sliding motion over the ground as well as protection, by a flexible carbon fiber or blast resistant material acting as a boot 46 or jacket element for additional guarding against sand and foreign elements. The material of the boot shall be flexible to allow for the repeated probe extension cycles.

The Green Energy Mine Defeat System improved components enhance the performance and stability while reducing maintenance time for longer durations in-service.

In order to improve planar stability, one or more gyroscopes may be employed. A lightweight disk of sufficient weight may be mounted and spun on the structure so as to resist toppling. The axes of rotation shall be set so as to contribute to maintain controlled lift along with roll and topple forces from the event. The action of starting the gyro would commence before and reach full speed before the event. Each Gyro may be supported with isolators of viscoelastic materials or other materials known in the art. The skilled in the art will adjust the global attitude of each gyro assembly to maximize the affect for vehicle stabilization.

Behind the vehicle chassis 21 is a containment blast plate 26, positioned upon status change to encompass the projected inverted conical zone of pressure, fire and fragmentation. Connecting the chassis to the blast plate is one variant of gas-fluid cartridges 29 with stepped release (0-200-800 lbs), which are body to plate connected, used as a dampening struts. The entire assembly is raised and lowered when not in use.

In another embodiment, a foil lever 30 creating a means of combined baffle and absorption are described. Within the stages of shock waves and fragmentation the blastplate is first moved rearward. In milliseconds after this action the pressure wave travels and strikes a plate of normal or curved geometry forming a foil and lever. As the pressure wave impinges upon the foil face it is pushed on the connected energy absorbing struts which are in turn connected to the rear blastplate or other containment space element. This arrangement of a foil lever may be organized in such a way in the containment space in any multiple of times in any suitable arrangement to maximize energy absorption. At the leading face of these foil levers may include a suitable face to reduce velocity to subsonic speeds. The foil angle may be adjusted at any angle to manage forces that will contribute to balancing the overall stability of the machine.

The billows 25 and curtain 25 are attached and assembled in accordion like manner on and along the sides of the containment space. The canopy 24 is attached in a folded parachute manner. Both are of a blast resistant material such as carbon fiber or better. As the mine is triggered, the blast plate and vehicle are lifted and sent in different directions. The blast travel distance is slightly less in distance to the blast plate 26. Therefore, initially causes a reverse direction of the total assembly. Through this action and the gas-fluid cartridges 29, energy is dissipated with a reaction being centrally resisted by the mass and size of the reciprocating system.

As those reciprocating system parts that are in ground contact and as a reaction to the mine detonation, a feedback loop is broken and a fail safe signal located along the feet is tripped on, when the connection is broken. The connecting arms are limit rated and are subject to the first and highest levels of stress. Upon the signal being sent to the optional gas ejection system 22, a propelled inert gas and fire suppression 23 system is activated for canopy deployment in an upward and reverse impulse direction. The canopy chute 24 path and speed is maximized upward for containment and canopy deployment from the top of assembly. A conventional set of three trailing hooks, left, center and right edges of the rear containment plate of the vehicle are employed to activate underground trigger mechanisms for offset hazards of above-ground, concealed mines.

In another embodiment, the canopy may have an intermediate or top section that is modified to mitigate the resulting pressure, fire and fragmentation. In this arrangement a single or multiple series of rectangular rings consisting of extensible rods, corner bars, and struts are used to form a strut ring. Other shapes to establish containment strut rings such as ovals, triangles, circles, polygons or curvilinear outlines are also possible. The resultant grouping from pressure wave reactions are established, the corresponding best shape fit which best dissipates the shock, pressure wave and fragmentation event.

The corners of the rectangle form reaction points. The corners have connectable ends which are able to make connection with pressure relieving struts 29, which may be telescopic. These components may be either for multiple use or replaceable. The principle of use is that the rectangles form a frame that the blast resistant material is connected onto in a billows curtain 25 method and the curtain is so connected, possibly unevenly pleated, from side to side, so as to slide along the lengths of the rectangle ring sides into a fully expanded manner. Therefore, as the canopy rectangle is propelled upward and subjected to any force, it has the ability to expand and be subjected to the stress and strain in the horizontal plane through the struts along the respective sides and further being contained by the expanding billows curtain sides. The unfolding nature of the canopy with the rectangular frames with struts included as described have the ability to be stacked in repetition.

As a later stage failsafe method of energy dissipation and to reduce the number of elements involved for energy dissipation, a top canopy breakaway section may be used. The principle of locating fragmentation baffles before top liftoff would provide a means of relieving overpressure with an overall smaller canopy.

A chute 50 may be introduced into the vehicle or robot chassis as a possible arrangement for gas and pressure flow. Chutes, Foils, tension bands and baffles are positioned to have the greatest effect to deflect and absorb energy and fragmentation.

A blast gate for any chute may be positioned at the entrance of a chute or foil. The gate acts as an initial pressure wave brake resisted by energy absorbing struts mounted to the gate plate and to the containment space. The gate orientation may be positioned so as to cause reactions from the pressure wave into the machine so as to absorb or contribute to stabilization. The chute may have a foil inside for reaction from lift. The concept of blast through structure provides for possibility of minimization of event reaction forces.

In a separate embodiment, a combined complementing element may be employed for vehicle and machine stabilizing and absorption requirements. As the triggering takes place, staged reactions are started and the pressure wave comes into contact with the mechanisms. In order to further dissipate the energy from the leading shockwave, a magneto flux sandwich system FIG. 10 may be used.

The pressure wave acting upward and outward reacts against any surface in proximity. The containment space so proportioned with triggering mechanisms present, create contact surfaces. The net result is to cause instability and overturning to the vehicle or robot machine. In aim to balance all forces, it is advantageous to compensate for these forces. A series of high strength conductive plates 57 may be arranged in a sandwich configuration for an immediate impulse reaction. These sandwich assemblies may be sized, shaped, arranged and hinged in multiple positions in the containment zone so as to maximize energy dissipation and deflection. The entire assembly configuration may be fixed or shock strut connected to the vehicle or machine. Formations imparting couples into the frame may be realized.

The system power source may be by an onboard generator and assisted from a gyro fitted for current generation. A current field is generated and wired to the system. The system comprises two or more rigid or semi rigid plates with conductive strips, poles or surfaces 48 for providing current field induction. Permanent magnets may be incorporated into the plate surface. Each surface is connected so as to allow limited freedom of movement out of plane as well as in plane, each surface forming a plate that has any array of openings.

The complimentary offset plate or surface has a mated array of openings which may contain an inverted or planar opposite set of shaped ducts. The planar angle of each duct may be of any angle so as to maximize the effect of pressure wave reduction. As a second stage to the system, the surfaces or plates may be conductive so as create a magnetic field for attractive or repulsive force which may be from permanent magnets or electromagnetic means. The magnetic field and corresponding magnetic flux may be varied and is provided at a desired strength for resistance, opening and or closing and may be area attenuated. The plate movement action may be actuated from voltage from a capacitor source. The plates may be layered with dielectric material so as to maximize repulsion and attraction effects. The plates may be held at a distance relative to another mechanically. Each plate may have any percentage of surface area open for pressure wave passage.

In one reaction case, the pressure field strikes the first plate and is pressed towards the secondary plate. As this motion takes place the magnetic field between the two plates is turned on, the plates acting into the direction of the pressure wave. In another reaction case, a second plate, having complimentary meshed ducts, is repulsed with sufficient flux density. As the pressure wave impacts the primary front plate the magnetic field is closed and the plates slam together. In both cases the opening or closing of the plates with the corresponding openings and ducts deflects and diverts pressure wave forces. Further reaction force can be provided by the use of pressure sensitive encased charges 34 at the bottom of each port stub. The total amount of reaction force can be staged to react to the uplift force encountered.

Leading edges of surfaces and openings may have modified ridges for drag and velocity reduction. A plate may have no openings. A third plate may be sandwiched for additional deflecting effects. In order to improve the plate deflection characteristics, the use of baffles creating a leading drag layer of suitable material strength may be placed in front of the plates. Sensors, pressure transducers and relays may be used to control any advance or delay required to optimize controlling change of the flux density of the magnetic field in the system.

The combined components are so arranged to dissipate the energy field with respect to its vector and by stage of the mine event and respond in a predetermined and controlled manner. A split blast plate with pressure struts can be used. As is the case with many structures that may encounter pressure waves, dissipating, collapsible and compressible medium in layers may contribute to protection of the intended space and surfaces or vacuum control volume may be incorporated on the surfaces or within the containment space in order to mitigate forces to be resisted or deflected. Each of the absorbing elements and mechanism are positioned and analyzed in a global vector summary around the machine centroid to arrive at the best use to resolve the set of forces to achieve overall stability.

A centerline path marking system mounted at the rear containment plate is provided whereby a path centerline is prepared with wheel brush and air system and marking with specialized material/paint at coded spaced intervals. The system also automatically paints low spots and where not proofed, unchecked or for skipped locations.

FIG. 1 shows the warning flag tube 6 mounted on the top of the vehicles chassis. FIG. 4 illustrates the detail for the self-contained, remote deployed warning flag system. The vehicle carries a remote deployed powder actuated anchored unfolding warning flag 4 in the top or on the side of the lower chassis body. At this location or mounted onto the side of the chassis a single to several warning flags tubes can be stored. This self-contained function allows the administration of possible deactivation or detonation to be controlled in a more efficient manner in addition to keeping personnel involvement to a minimum for marking the hazard by remotely placing near to located hazards.

The individual flag 35 becomes upright when removed from tube and expand automatically with the individual sides being of flexible spring-to-rod 42 connections. Upon locating the anchor base 38 to its desired location by the operator, the base is positioned and trigger 37 discharged by the use of the robotic arm, securing it into the ground by the powder actuated anchor 39 making the flag spiked into the ground. An additional automatic trigger for discharge may be used at the far base location 41. To aid in the ability to weather wind conditions, the top and base are vented 36 & 40 open to reduce blow over affect.

Through the progress of technology, the geometry and configuration of machine structure and components may be more streamlined and efficient. This process of development may include the energy dissipation, force balancing and containment elements being located anywhere in or through the structure, possibly within the wheelbase. The methods stated herein apply science and engineering result in a planned staged dynamic hysteresis through a vehicle, machine, robot or structure with mechanisms, methods and devices to detect, trigger and/or absorb energy of a mine and resulting blast shockwave and contain fragmentation.

The invention has been described with respect to particular embodiments, modifications and substitutions within the spirit and scope of the invention and will be apparent to those of skill in the art that individual elements identified herein as belonging to a particular embodiment, may be included in other embodiments of the invention as well. The present invention may be embodied in other specific forms without departing from the attributes herein described. The illustrated embodiments and examples of use should be considered in all respects as examples and illustrative and not restrictive. The devices described herein, individually or in combination may be advantageously be fixed as attachments for or onto other vehicles to achieve desired results which are needed.

I claim:

1. An apparatus on a vehicle or robot for containing landmine blasts, comprising:

a plurality of energy dissipating struts mounted to said vehicle or robot and at least one blast sandwich assembly, wherein said struts are energy absorbing and connected on one end to said vehicle or robot and on the opposite end to said blast sandwich assembly;

the blast sandwich assembly having two or more blast resistant plates with space between said plates and at least one said plate having multiple openings;

said plate openings having internally aligned ducts suitably fashioned to deflect energy;

and wherein said plates are connected at edges.

2. The apparatus of claim 1, wherein said plates have a distance in space between said plates controlled by electromagnetic forces and are hinge connected at edges.

3. The apparatus of claim 1 wherein energy absorbing material is layered onto one or more of said plate surfaces.

4. The apparatus of claim 1, 2 or 3, wherein two or more of said blast sandwich assemblies further comprise forming a larger surface wherein said blast sandwich assemblies are hinge connected to each other.

5. The apparatus of 1 or 2, wherein at least one said blast sandwich assembly is hinged to open as a gate.

6. The apparatus of 1 or 2, further comprising pressure sensitive encased charges positioned to counteract upward forces from said mine blast.

7. The apparatus of 1 or 2, wherein said robot contains a gyroscope.

8. The apparatus of 1 or 2, wherein said robot contains one or more chutes through said robot.

9. The apparatus of 1 or 2, wherein said robot comprises a frame having telescopic cylinders supporting a turret.

10. The apparatus of 1 or 2, wherein said robot comprises an on-board computer for user remote control.

11. The apparatus of 1 or 2, wherein said robot comprises an on-board computer using global positioning satellite positioning for automatic guidance control operation.

* * * * *